US008793839B2

(12) United States Patent
Iwaki

(10) Patent No.: US 8,793,839 B2
(45) Date of Patent: Aug. 5, 2014

(54) RETRACTING DEVICE

(75) Inventor: Junpei Iwaki, Mie (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 0 days.

(21) Appl. No.: 13/883,683

(22) PCT Filed: Oct. 14, 2011

(86) PCT No.: PCT/JP2011/073626

§ 371 (c)(1),
(2), (4) Date: May 6, 2013

(87) PCT Pub. No.: WO2010/066883

PCT Pub. Date: May 24, 2012

(65) Prior Publication Data

US 2013/0219657 A1 Aug. 29, 2013

(30) Foreign Application Priority Data

Nov. 16, 2010 (JP) ..... 2010-256338

(51) Int. Cl.

| | |
|---|---|
| ***E05F 1/08*** | (2006.01) |
| ***E05F 3/04*** | (2006.01) |
| ***E05F 3/00*** | (2006.01) |
| ***E05F 5/02*** | (2006.01) |
| ***E05F 5/00*** | (2006.01) |
| ***E05F 3/14*** | (2006.01) |
| ***E05F 1/16*** | (2006.01) |

(52) U.S. Cl.

CPC ... *E05F 3/00* (2013.01); *E05F 3/04* (2013.01); *E05F 5/027* (2013.01); *E05F 5/003* (2013.01); *E05F 3/14* (2013.01); *E05F 1/16* (2013.01); *E05Y 2201/412* (2013.01); *E05Y 2201/424* (2013.01)

USPC ..... 16/72; 16/76; 16/71; 16/61; 16/49

(58) Field of Classification Search

USPC ..... 16/49, 71, 86 B, 70, 72, 80, 85, DIG. 10, 16/91, 94 R, 102, 106, 107, 76, 61; 49/404, 49/407, 386, 451, 454, 455, 409; 312/322, 312/332.1, 333, 334.44, 334.46, 319.1; 292/262, 266–270, 277, 173, 38, 292/DIG. 46; 160/199, 196.1, 206

See application file for complete search history.

(56) References Cited

U.S. PATENT DOCUMENTS

| | | | | |
|---|---|---|---|---|
| 2,277,316 A * | 3/1942 | Garrison | ..... | 292/274 |
| 2,744,779 A * | 5/1956 | Ellis | ..... | 292/278 |

(Continued)

FOREIGN PATENT DOCUMENTS

| | | |
|---|---|---|
| JP | 2009-287355 | 12/2009 |
| JP | 2010-156199 | 7/2010 |
| WO | WO 2006011294 A1 * | 2/2006 |

OTHER PUBLICATIONS

International Search Report, PCT/JP2011/073626, Nov. 8, 2011.

*Primary Examiner* — Chuck Mah
(74) *Attorney, Agent, or Firm* — Young & Thompson

(57) ABSTRACT

Provided is a retracting device in which dampers have improved durability and strokes of operation of the dampers are not reduced. A first slider 14-1 for assisting closing, a second slider 14-2 for assisting opening, and a damper base 22 are provided in an elongating base 12 to be slidable in a longitudinal direction of the base 12. The damper base 22 is disposed between the first slider 14-1 and the second slider 14-2. A first damper 24 is provided over between the first slider 14-1 and the damper base 22 and a second damper 25 is provided over between the second slider 14-2 and the damper base 22.

8 Claims, 23 Drawing Sheets

(56) References Cited

U.S. PATENT DOCUMENTS

| | | | | | |
|---|---|---|---|---|---|
| 3,630,560 | A * | 12/1971 | Atkins et al. | 292/270 |
| 4,004,372 | A * | 1/1977 | Beard et al. | 49/404 |
| 4,506,407 | A * | 3/1985 | Downey | 16/48.5 |
| 5,285,596 | A * | 2/1994 | Kinsey | 49/404 |
| 5,450,651 | A * | 9/1995 | Coleman et al. | 16/82 |
| 5,461,754 | A * | 10/1995 | Tillmann et al. | 16/82 |
| 5,906,026 | A * | 5/1999 | Junttila | 16/85 |
| 6,253,417 | B1 * | 7/2001 | Rusiana | 16/82 |
| 6,691,465 | B1 * | 2/2004 | Stephan | 49/404 |
| 7,028,370 | B2 * | 4/2006 | Hoshide et al. | 16/96 R |
| 7,430,832 | B2 * | 10/2008 | Hung | 49/404 |
| 2007/0283524 | A1 * | 12/2007 | Gordon | 16/78 |
| 2010/0037525 | A1 | 2/2010 | Sato | |
| 2010/0071154 | A1 * | 3/2010 | Bortoluzzi | 16/85 |
| 2010/0123378 | A1 * | 5/2010 | Chen et al. | 312/333 |
| 2010/0229341 | A1 * | 9/2010 | Tomioka | 16/49 |
| 2011/0023370 | A1 * | 2/2011 | Zimmer et al. | 49/360 |
| 2011/0067313 | A1 * | 3/2011 | Walhorn | 49/360 |
| 2011/0167588 | A1 * | 7/2011 | Chang et al. | 16/71 |
| 2013/0014343 | A1 * | 1/2013 | Tanno et al. | 16/49 |

* cited by examiner

RETRACTING DEVICE

TECHNICAL FIELD

The present invention relates to a retracting device for assisting closing and opening of an opening and closing body such as a sliding door, a folding door, or a drawer.

BACKGROUND ART

With this type of retracting device, when a sliding door is moved manually along a guide rail in a closing direction or an opening direction, a biasing force in the closing direction or the opening direction by a biasing member such as a coil spring is exerted on the sliding door at a certain point. The sliding door moves automatically to a fully closed position or a fully open position by the biasing force of the biasing member.

In Patent Literature 1, a retracting device that assists closing and opening of a sliding door is disclosed. A guide rail extending in opening and closing directions of the sliding door is mounted to a ceiling. The retracting device is received in the guide rail and can slide in the guide rail in a longitudinal direction by rollers. The sliding door suspends from the retracting device. There are a first pin and a second pin attached to the guide rail. The retracting device is provided with a first slider which can catch the first pin and a second slider which can catch the second pin.

When the sliding door is moved manually in the closing direction or the opening direction, the retracting device also moves with the sliding door in the closing direction or the opening direction. When the sliding door is moved manually in the closing direction and the retracting device is moved in the closing direction and reaches a certain point of the guide rail, the first slider of the retracting device for assisting the closing catches the first pin. Then, lock of the first slider with the retracting device is released and the retracting device moves automatically in the closing direction due to a biasing force of a biasing member and the sliding door suspending from the retracting device moves automatically to a fully closed position. When the sliding door is manually moved in the opening direction, in the same way as in closing of the sliding door, the second slider for assisting the opening catches the second pin at a certain point and the sliding door moves automatically to a fully open position due to the biasing force of the biasing member.

In the retracting device described in Patent Literature 1, a linear damper is provided over between the first slider and the second slider in order to cushion impact when the sliding door is closed fully and opened fully. In other words, an end portion of a damper main body of the linear damper is attached to the first slider and a tip end portion of a rod of the linear damper is attached to the second slider (see claim 1 of Patent Literature 1).

CITATION LIST

Patent Literature

Patent Literature 1: Japanese Patent Application Laid-Open No. 2009-287355

SUMMARY OF INVENTION

Technical Problem

However, to provide a linear damper over between the first slider for assisting the closing of the retracting device and the second slider for assisting the opening, a long linear damper is required. As a result, the size of the linear damper increases or extension and contraction of the rod is not carried out smoothly. Moreover, a stroke of the linear damper is limited to a length not greater than a half of a distance between the first slider and the second slider and therefore the stroke of the linear damper becomes small.

Therefore, it is an object of the present invention to provide a retracting device which does not require a long damper to damp opening and closing of an opening and closing body and in which a stroke of the damper is secured.

Solution to Problem

In order to solve the problem, according to one aspect of the invention, there is provided a retracting device including: a base extending in a longitudinal direction; a first slider for assisting closing and provided in the base to be slidable in a longitudinal direction; a second slider for assisting opening and provided in the base to be slidable in the longitudinal direction; a damper base disposed between the first slider and the second slider to be slidable in the longitudinal direction relative to the base; a first damper provided over between the first slider and the damper base to cause a damping force as a distance between the first slider and the damper base reduces; and a second damper provided over between the second slider and the damper base to cause a damping force as a distance between the second slider and the damper base reduces, wherein the distance between the first slider and the damper base and the distance between the damper base and the second slider reduce as the base moves in a closing direction relative to the first slider due to a biasing force of a biasing member and the distance between the second slider and the damper base and the distance between the damper base and the first slider reduce as the base moves in an opening direction relative to the second slider due to a biasing force of a biasing member.

Advantageous Effects of Invention

According to the invention, as the first damper is provided over between the damper base and the first slider which are slidably provided to the base and the second damper is provided over between the damper base and the second slider, it is possible to reduce respective lengths of the first damper and the second damper. Therefore, it is possible to stabilize operations of the first and second dampers. Moreover, as the sum of a stroke of the first damper and a stroke of the second damper serves as an entire stroke, it is possible to secure the strokes of the dampers.

DESCRIPTION OF EMBODIMENTS

Figure 1A:
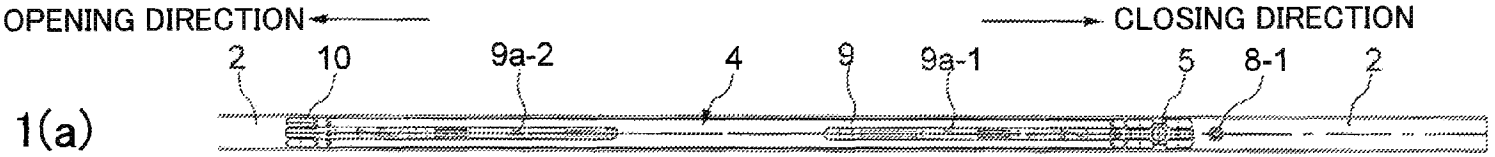
FIGS. 1(*a*) to 1(*c*) are outline views of a retracting device according to a first exemplary embodiment of the present invention (FIG. 1(*a*) is a plan view, FIG. 1(*b*) is a side view of an open state, and FIG. 1(*c*) is a side view of a closed state).
Figure 1B:
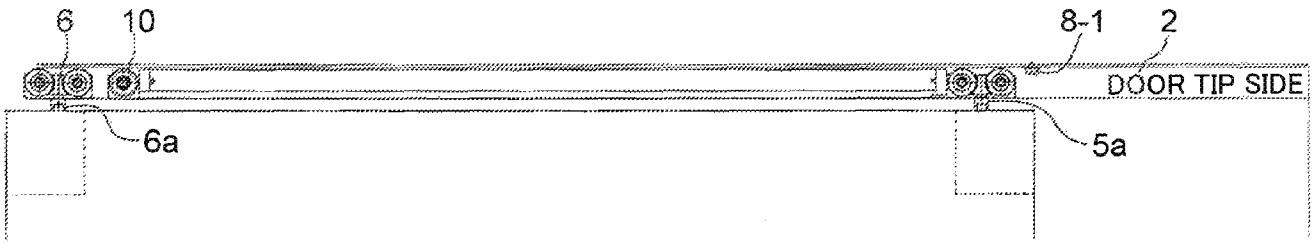
Figure 1C:
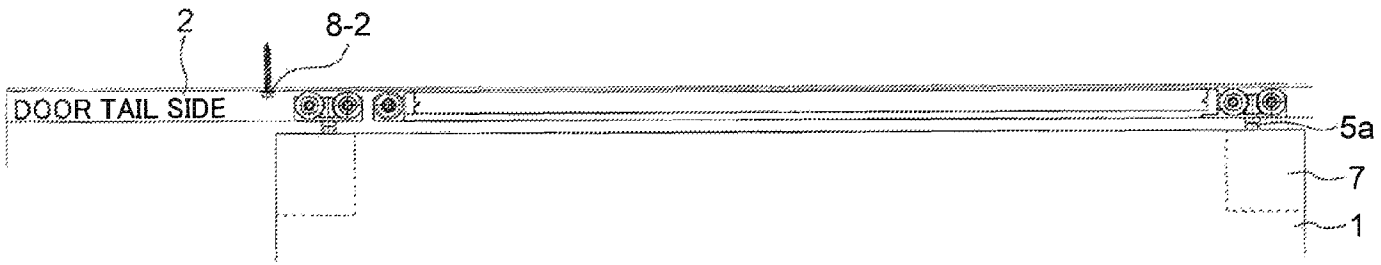

With reference to the drawings, a retracting device according to a first exemplary embodiment of the present invention will be described below. FIGS. 1(*a*) to 1(*c*) are outline views of the retracting device according to the first exemplary embodiment. A guide rail 2 elongating in a moving direction of a sliding door 1 is fixed to ceiling. A pair of door rollers 5 and 6 is inserted into the guide rail 2. The sliding door 1 suspends from the pair of door rollers 5 and 6 via position adjusting units 7. The position in the vertical direction and width direction of the sliding door 1 relative to the retracting device 4 can be adjusted by the position adjusting units 7. The elongating retracting device 4 is inserted into the guide rail 2. The retracting device 4 is attached to one of the door rollers 5. A door roller 10 is attached to an end portion in an opening direction of the retracting device 4 so that the retracting device 4 can move smoothly in the guide rail 2. The retracting device 4 moves in the guide rail 2 from a fully open state shown in FIG. 1(*b*) to a fully closed state in FIG. 1(*c*) in conjunction with movement in opening and closing directions of the sliding door 1.

The guide rail 2 has an approximately rectangular cross section and is mounted to the ceiling by countersunk screws. At a bottom part of the guide rail 2, a slit (not shown) is formed throughout an entire length of the guide rail 2 in a longitudinal direction. Pairs of left and right door rollers 5, 6, and 10 of the retracting device 4 roll on an upper surface of the bottom part of the guide rail 2. There are connecting shafts 5*a* and 6*a* that project from the door rollers 5 and 6 via the slit in the guide rail 2 for connecting the door rollers 5 and 6 to the sliding door 1.

At an upper part of the guide rail 2, first and second trigger pins 8-1 and 8-2 are attached at an interval in the moving direction of the retracting device 4. The first trigger pin 8-1 is used to assist closing of the sliding door 1 and is attached to a position where the retracting device 4 starts to operate for the sliding door 1 moving in the closing direction. The second trigger pin 8-2 is used to assist opening of the sliding door 1 and is attached to a position where the retracting device 4 starts to operate for the sliding door 1 moving in the opening direction. A cover 9 of the retracting device 4 has slits 9*a*-1 and 9*a*-2 formed to receive the first and second trigger pins 8-1 and 8-2 when the retracting device 4 moves toward the first and second trigger pins 8-1 and 8-2. The first and second trigger pins 8-1 and 8-2 pass between the paired left and right door rollers 5, 6, and 10 so that the first and second trigger pins 8-1 and 8-2 do not interfere with the door rollers 5, 6, and 10.

Figure 2A:
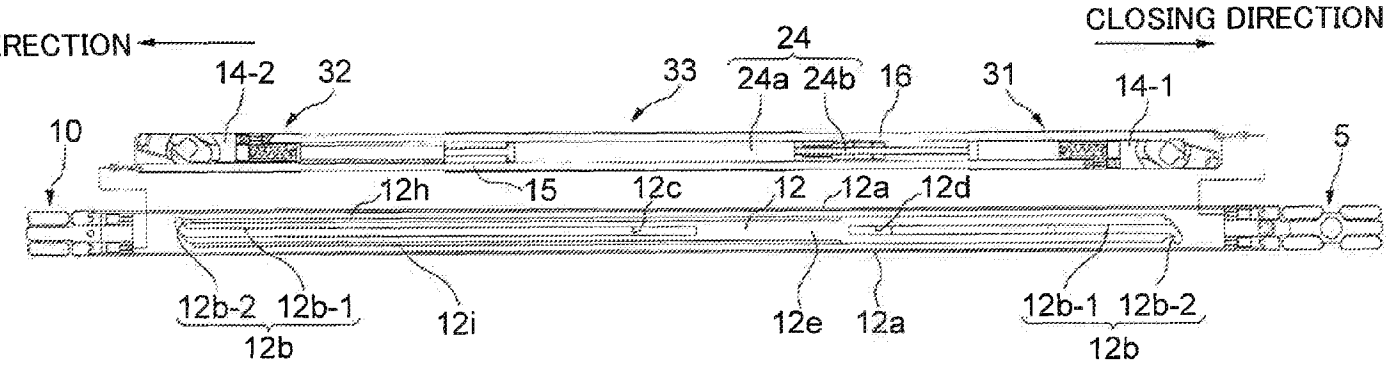
FIGS. 2(*a*) and 2(*b*) are exploded views of the retracting device (FIG. 2(*a*) is a plan view and FIG. 2(*b*) is a vertical cross sectional view along opening and closing directions).
Figure 2B:
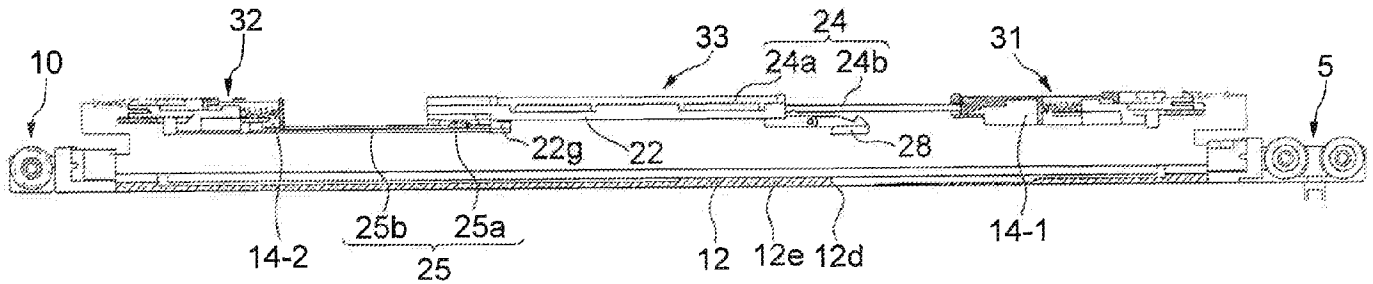

FIGS. 2(*a*) and 2(*b*) are exploded views of the retracting device 4. FIGS. 2(*a*) and 2(*b*) illustrate a base 12 from which first and second slider assemblies 31 and 32 and a damper assembly 33 are detached. FIG. 2(*a*) is a plan view and FIG. 2(*b*) is a vertical cross sectional view along the opening and closing directions. The retracting device 4 has a base 12 elongating in the opening and closing directions, the first and second slider assemblies 31 and 32 provided to both ends in a longitudinal direction of the base 12, and the damper assembly 33 disposed between the first slider assembly 31 and the second slider assembly 32. The first slider assembly 31 assists the closing of the sliding door 1 and the second slider assembly 32 assists the opening of the sliding door 1. The damper assembly 33 damps the closing and the opening of the sliding door 1.

As shown in FIGS. 2(*a*) and 2(*b*), the door rollers 5 and the pair of left and right rollers 10 are fixed to the both ends in the longitudinal direction of the base 12. The base 12 has an approximately U-shaped cross section and has a bottom wall 12*e* and paired side walls 12*a* facing each other. The first slider assembly 31 is disposed slidably at the end in the closing direction of the base 12. Sliding of the first slider assembly 31 is guided by the side walls 12*a* of the base 12. A pulling coil spring 15 is provided as a biasing member over between the end in the opening direction of the base 12 and the first slider assembly 31. The first slider assembly 31 slides automatically in the base 12 by a biasing force of the pulling coil spring 15. The second slider assembly 32 is disposed slidably at the end in the opening direction of the base 12. Sliding of the second slider assembly 32 is guided by the side walls 12*a* of the base 12. A pulling coil spring 16 is provided as a biasing member over between the end in the closing direction of the base 12 and the second slider assembly 32. The second slider assembly 32 slides automatically in the base 12 by a biasing force of the pulling coil spring 16.

Figure 3A:
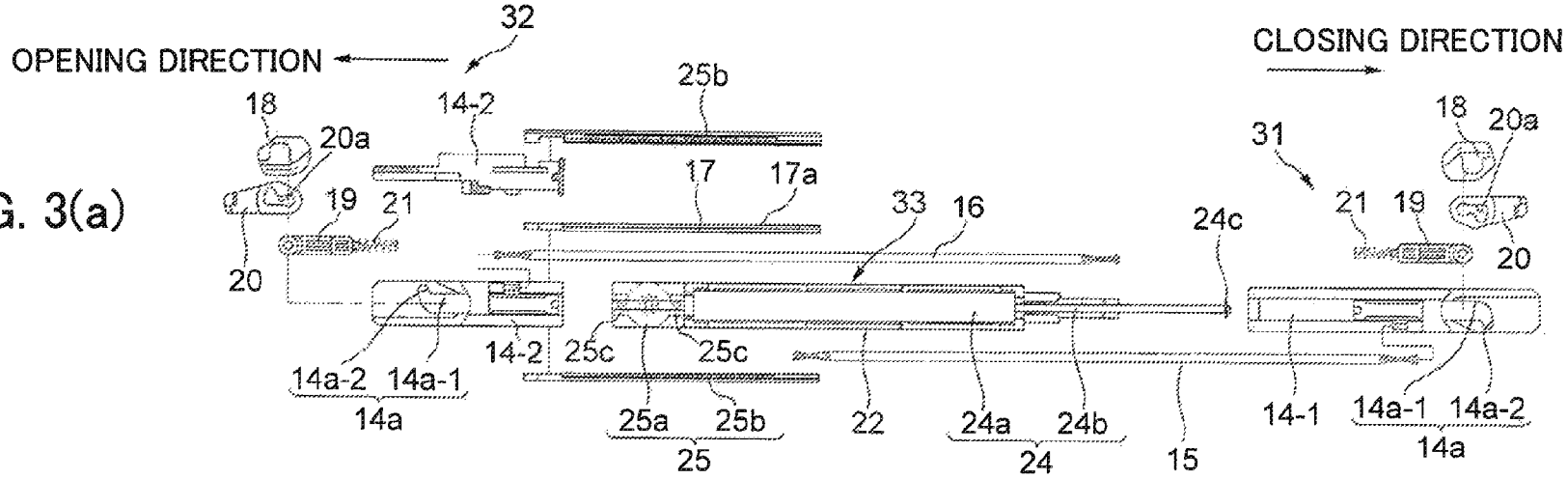
FIGS. 3(*a*) and 3(*b*) are exploded views of the retracting device (FIG. 3(*a*) is a plan view and FIG. 3(*b*) is a vertical cross sectional view along opening and closing directions).
Figure 3B:
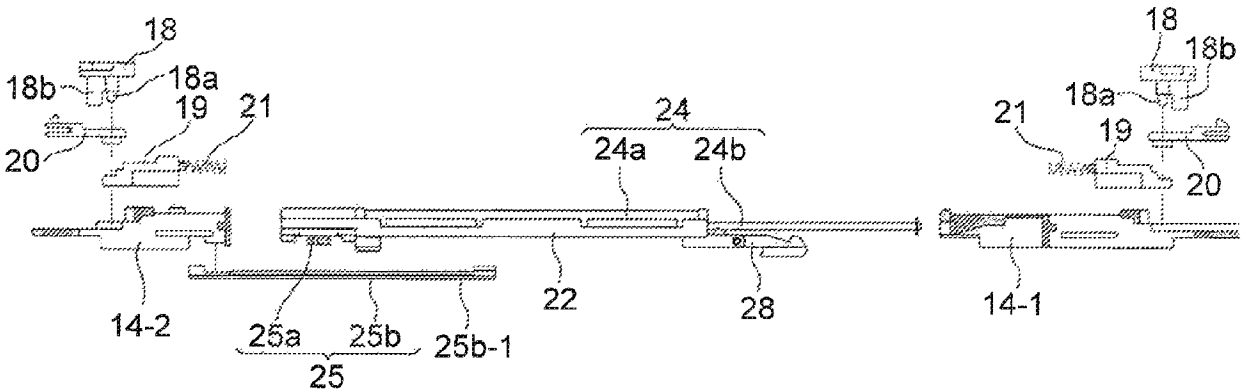

FIGS. 3(*a*) and 3(*b*) are exploded views of the first and second slider assemblies 31 and 32 and the damper assembly 33. FIG. 3(*a*) is a plan view and FIG. 3(*b*) is a vertical sectional view along the opening and closing directions. As shown in FIGS. 3(*a*) and 3(*b*), the first slider assembly 31 has a first slider 14-1 and a trigger catcher 18 mounted in the first slider 14-1. The trigger catcher 18 is for catching the first trigger pin 8-1. The trigger catcher 18 is supported at a tip end in the closing direction of a trigger pusher 19 to be rotatable in the horizontal plane. A malfunction reset cam 20 is also supported by the trigger pusher 19 to be rotatable in the horizontal plane. A rotation shaft 18*a* and a locking piece 18*b* of the trigger catcher 18 pass through an opening 20*a* of the malfunction reset cam 20 and are fitted in a trigger catcher guide slit 14*a* formed in the first slider 14-1 and a trigger catcher guide groove 12*b* (see FIG. 2(*a*)) formed in the base 12 to be slidable in the longitudinal direction. There is a compression coil spring 21 provided over between the trigger pusher 19 and the first slider 14-1.

As illustrated in FIGS. 2(*a*) and 2(*b*), the first slider 14-1 is positioned at a lock position at the end in the closing direction of the base 12. In an area where the first slider 14-1 operates in the bottom wall 12*e* of the base 12, the trigger catcher guide groove 12*b* is formed, including a straight groove 12*b*-1 extending in the longitudinal direction and a locking groove 12*b*-2 bent to one side at the end in the closing direction of the straight groove 12*b*-1. When the locking piece 18*b* of the trigger catcher 18 is fit in the locking groove 12*b*-2, the first slider 14-1 is locked. The trigger pusher 19 and the compression coil spring 21 hold the state in which the locking piece 18*b* of the trigger catcher 18 is fitted in the locking groove 12*b*-2 and then hold the lock position of the first slider 14-1. The malfunction reset cam 20 is provided to return the first slider 14-1 to the lock position even if the lock of the first slider 14-1 is released by malfunction.

As illustrated in FIG. 3(*a*), the second slider assembly 32 includes approximately the same component parts as the first slider assembly 31. The second slider assembly 32 has a second slider 14-2 and a trigger catcher 18 for catching the second trigger pin 8-2. The trigger catcher 18 is supported at a tip end in the opening direction of the trigger pusher 19 to be rotatable in the horizontal plane. A malfunction reset cam 20 is also supported by the trigger pusher 19 to be rotatable in the horizontal plane. A rotation shaft 18*a* and a locking piece 18*b* of the trigger catcher 18 pass through an opening 20*a* of the malfunction reset cam 20 and fit in a trigger catcher guide slit 14*a* formed in the second slider 14-2 and a trigger catcher guide groove 12*b* formed in the base 12 to be slidable in the longitudinal direction. There is a compression coil spring 21 provided over between the trigger pusher 19 and the second slider 14-2.

As illustrated in FIGS. 2(*a*) and 2(*b*), the second slider 14-2 is positioned at a lock position at the end in the opening direction of the base 12. In an area where the second slider 14-2 operates in the bottom wall 12*e* of the base 12, the trigger catcher guide groove 12*b* is formed, including a straight groove 12*b*-1 extending in the longitudinal direction and a locking groove 12*b*-2 bent to one side at the end in the closing direction of the straight groove 12*b*-1. When the locking piece 18*b* of the trigger catcher 18 is fit in the locking groove 12*b*-2, the second slider 14-2 is locked. The trigger pusher 19 and the compression coil spring 21 hold the state in which the locking piece 18*b* of the trigger catcher 18 is fit in the locking groove 12*b*-2 and then hold the lock position of the second slider 14-2. The malfunction reset cam 20 is provided to return the second slider 14-2 to the lock position even if the lock of the second slider 14-2 is released by malfunction.

As illustrated in FIG. 2(*a*), between the paired side walls 12*a* of the base 12, the damper assembly 33 is fitted therein slidably. In the bottom wall 12*e* of the base 12, a damper base guide groove 12*c* is formed. A damper base 22 of the damper assembly 33 has a leg part 22*g* to be fit into the damper base guide groove 12*c*. The damper base 22 slides in the base 12 in the longitudinal direction as guided by the paired side walls 12*a* of the base 12 and the damper base guide groove 12*c*.

A linear damper 24 is provided as a first damper over between the damper base 22 and the first slider 14-1. As illustrated in FIGS. 3(*a*) and 3(*b*), the linear damper 24 has a tubular damper main body 24*a* and a rod 24*b* extendable relative to the damper main body 24*a*. In the damper main body 24*a*, a piston (not shown) is provided to be connected to the rod 24*b*. The damper main body 24*a* is filled with liquid such as oil. With extension and contraction of the rod 24*b*, the piston moves in the damper main body 24*a* and viscous resistance of the liquid causes a damping force. The piston sometimes has an orifice for passage of the oil. The damper main body 24*a* is mounted to the damper base 22 and a tip end of the rod 24*b* is attached to the first slider 14-1. As a distance between the first slider 14-1 and the damper base 22 reduces, the rod 24*b* contracts to generate a damping force in the linear damper 24.

A rotary damper 25 is provided as a second damper over between the damper base 22 and the second slider 14-2. As illustrated in FIGS. 3(*a*) and 3(*b*), the rotary damper 25 has a disc-shaped damper main body 25*a* to which a pinion is rotatably provided and a slide rack 25*b* engaging with the pinion. The damper main body 25*a* is filled with liquid such as oil. A rotor (not shown) is connected to a rotation shaft of the pinion. When the rotor rotates in the damper main body 25*a*, viscous resistance of the liquid causes a damping force. The damper main body 25*a* is mounted to the damper base 22 and the slide rack 25*b* is attached to the second slider 14-2. In the damper main body 25*a*, a pair of overhanging parts 25*c* is formed and is connected to the damper base 22. The slide rack 25*b* is slidable with the second slider 14-2 in the longitudinal direction relative to the base 12. As the base 12 moves in the opening direction relative to the second slider 14-2 and a distance between the second slider 14-2 and the damper base 22 reduces, the pinion of the damper main body 25*a* rotates to generate a damping force in the rotary damper 25.

Attached to the second slider 14-2 is a slide guide 17 for preventing movement of the damper base 22 in a direction orthogonal to a sliding direction to thereby prevent the slide rack 25*b* from coming off the pinion of the damper main body 25*a*. The slide guide 17 has approximately the same length as the slide rack 25*b* and is disposed on an opposite side of the damper main body 25*a* from the slide rack 25*b*. A leg part 25*b*-1 at a lower part of the slide rack 25*b* is fit in a rack guide groove 12*i* (see FIG. 2(*a*)) in the base 12 and a leg part 17*a* at a lower part of the slide guide 17 is fit in a guide groove 12*h* (see FIG. 2(*a*)) in the base 12.

Figures 4A, 4B:
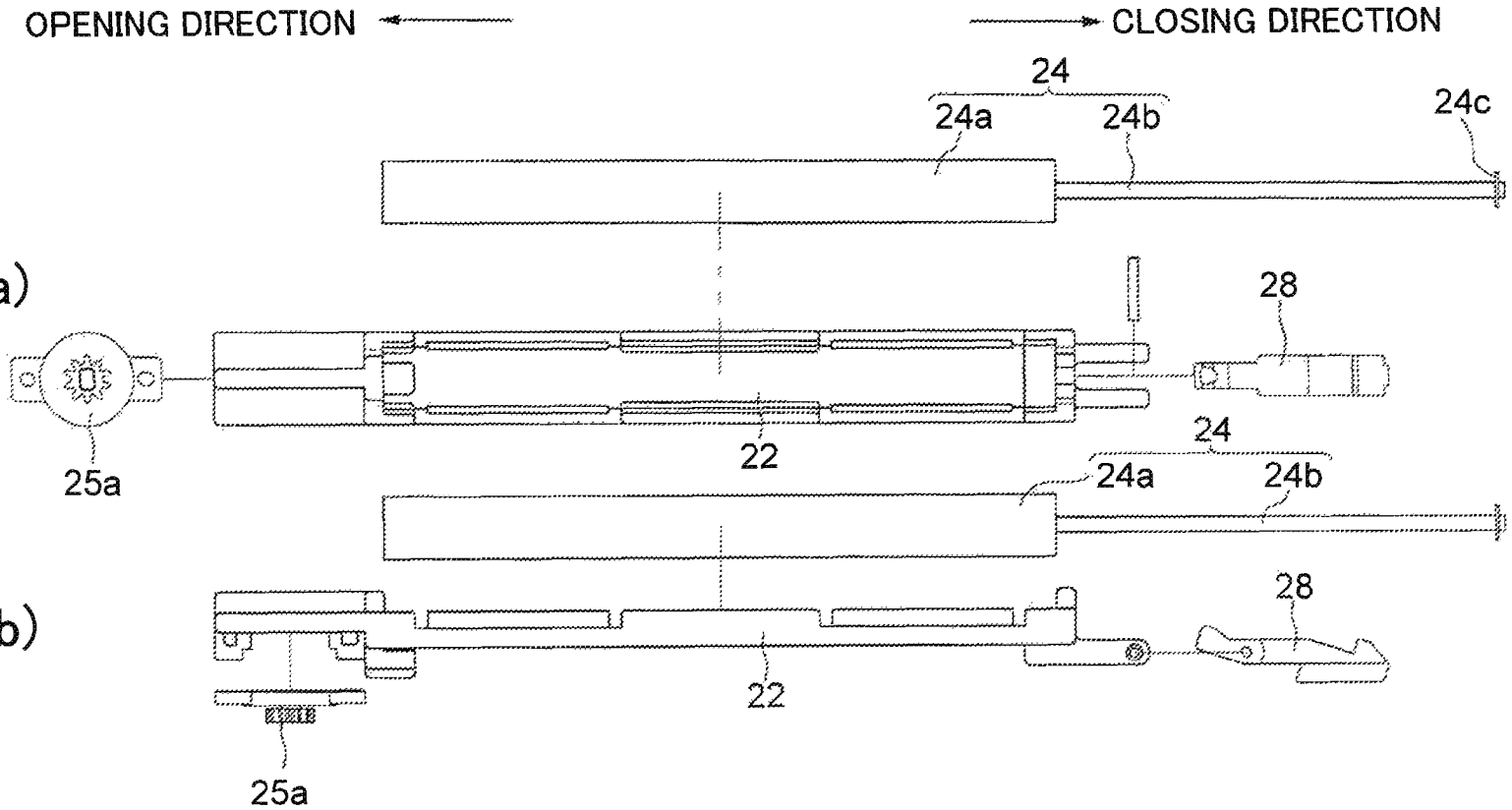
FIGS. 4(*a*) and 4(*b*) are exploded views of a damper assembly (FIG. 4(*a*) is a plan view and FIG. 4(*b*) is a side view).

FIGS. 4(*a*) and 4(*b*) are exploded views of the damper assembly 33. FIG. 4(*a*) is a plan view and FIG. 4(*b*) is a side view. The linear damper 24 and the rotary damper 25 are mounted to the damper base 22. At the end in the closing direction of the damper base 22, a damper lock 28 for the first slider is attached thereto to be rotatable in the vertical plane. In the base 12, a lock hole 12*d* (see FIGS. 2(*a*) and 2(*b*)) is formed as a damper lock engaging piece for engagement of the damper lock 28 therein. When the damper lock 28 engages in the lock hole 12*d* of the base 12, the damper base 22 is locked so that the damper base 22 cannot slide in the longitudinal direction relative to the base 12. When engagement between the damper lock 28 and the lock hole 12*d* of the base 12 is released, the damper base 22 comes to slide in the longitudinal direction relative to the base 12.

Next description is made about the structure of each part of the retracting device 4.

Figures 5A, 5B, 5C, 5D:
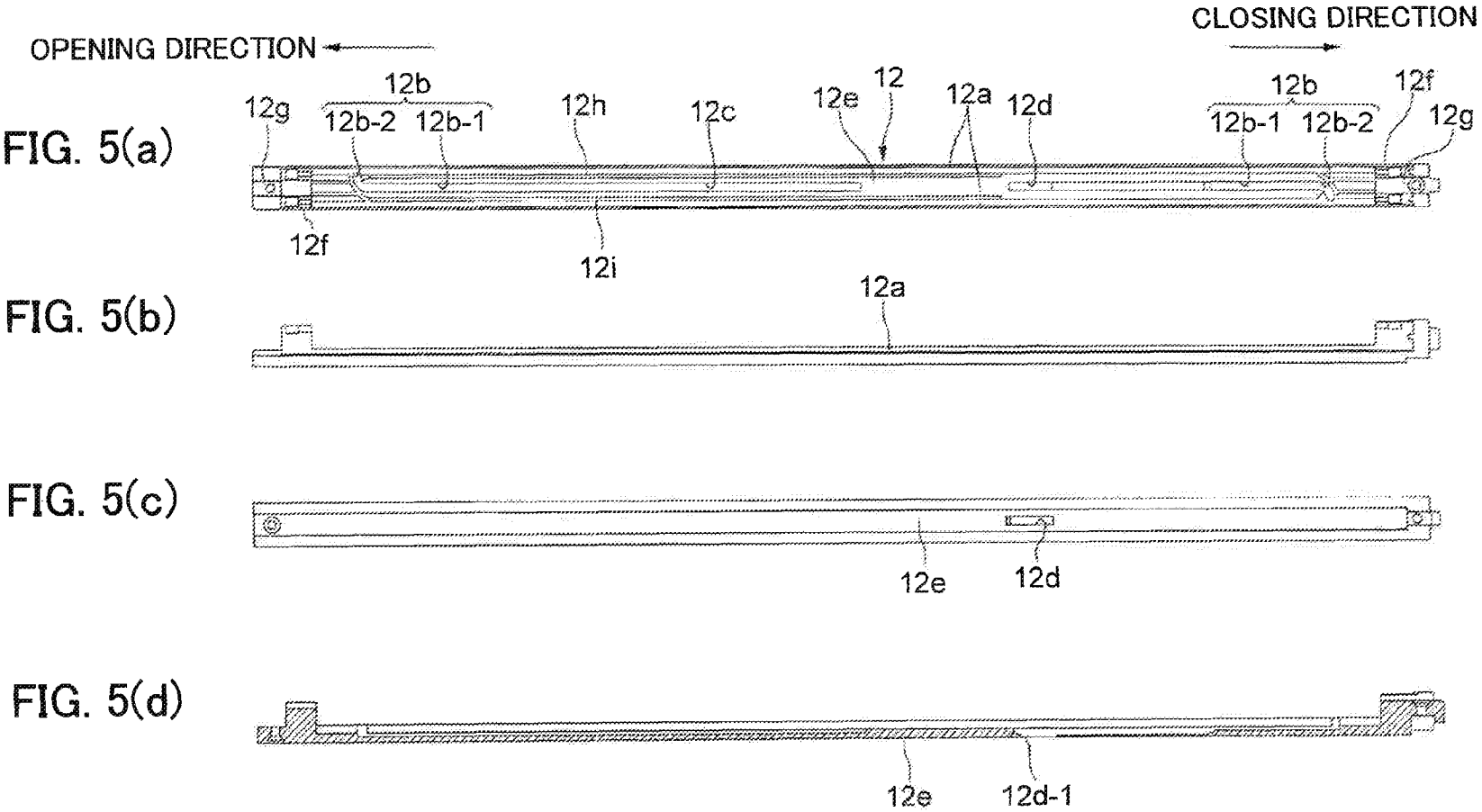
FIGS. 5(*a*) to 5(*d*) illustrate a base (FIG. 5(*a*) is a plan view, FIG. 5(*b*) is a side view, FIG. 5(*c*) is a bottom view, and FIG. 5(*d*) is a cross sectional view).

FIGS. 5(*a*) to 5(*d*) illustrate the base 12. FIG. 5(*a*) is a plan view, FIG. 5(*b*) is a side view, FIG. 5(*c*) is a bottom view, and FIG. 5(*d*) is a cross sectional view. The elongating base 12 has both ends in the longitudinal direction where connecting parts 12*g* are formed as connected to the door rollers 5 and 6. At the end in the opening direction of the base 12, a wall part 12*f* is formed to which an end of the pulling coil spring 15 is connected. At the end in the closing direction of the base 12, a wall part 12*f* is formed to which an end of the pulling coil spring 16 is connected. At both sides in the width direction of the base 12, the paired side walls 12*a* are formed. The paired side walls 12*a* guide sliding of the first slider 14-1 and the second slider 14-2 in the longitudinal direction relative to the base 12 and guide sliding of the damper base 22 in the longitudinal direction relative to the base 12.

At the end in the closing direction of the bottom wall 12*e* of the base 12, the trigger catcher guide groove 12*b* is formed having the straight groove 12*b*-1 extending in the longitudinal direction and the locking groove 12*b*-2 that is bent to the side (downward in FIG. 5(*a*)) at the end in the closing direction of the straight groove 12*b*-1. In this trigger catcher guide groove 12*b*, the rotation shaft 18*a* and the locking piece 18*b* of the trigger catcher 18 of the first slider assembly 31 fit.

At the end in the opening direction of the bottom wall 12*e* of the base 12, the trigger catcher guide groove 12*b* is formed having the straight groove 12*b*-1 extending in the longitudinal direction and the locking groove 12*b*-2 that is bent to the side (upward in FIG. 5(*a*)) at the end in the closing direction of the straight groove 12*b*-1. In this trigger catcher guide groove 12*b*, the rotation shaft 18*a* and the locking piece 18*b* of the trigger catcher 18 of the second slider assembly 32 fit.

At the end in the opening direction of the right trigger catcher guide groove 12*b*, a rectangular-shaped lock hole 12*d* is formed as a damper lock engaging piece that engages with the damper lock 28. Aside surface 12*d*-1 in the opening direction of the lock hole 12*d* is inclined in such a manner that the lock hole 12*d* becomes larger at the bottom of the lock hole 12*d* than at the top of the lock hole 12*d*. This is because, as illustrated in FIG. 2(*b*), engagement of the damper lock 28 in the lock hole 12*d* is secured when the first slider 14-1 pushes the rod 24*b* of the linear damper 24.

At the bottom wall 12*e* of the base 12, the damper base guide groove 12*c* for guiding the damper base 22 is formed to be continuous with the left trigger catcher guide groove 12*b*. On both sides in the width direction of the trigger catcher guide groove 12*b* and the damper base guide groove 12*c*, the rack guide groove 12*i* and the guide groove 12*h* for guiding the slide rack 25*b* and the slide guide 17 are formed.

Figure 6A:
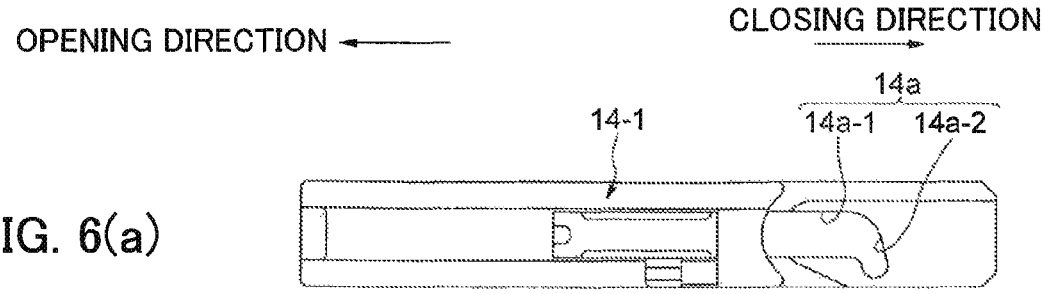
FIGS. 6(*a*) and 6(*b*) illustrate a slider (FIG. 6(*a*) is a plan view and FIG. 6(*b*) is a cross sectional view).
Figure 6B:
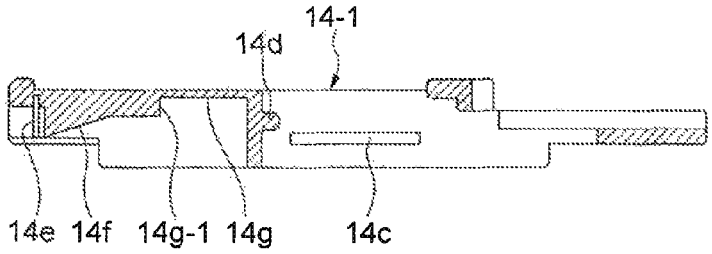

FIGS. 6(*a*) and 6(*b*) are detail views of the first slider 14-1. FIG. 6(*a*) is a plan view and FIG. 6(*b*) is a cross sectional view. In the first slider 14-1, the trigger catcher guide slit 14*a* is formed which has a straight slit 14*a*-1 extending in the longitudinal direction to the closing side and a locking slit 14*a*-2 bent to the side at the end in the closing direction of the straight slit 14*a*-1. This trigger catcher guide slit 14*a* corresponds to the trigger catcher guide groove 12*b* of the base 12 and passes through the first slider 14-1 vertically. When the first slider 14-1 reaches the lock position, the trigger catcher guide slit 14*a* and the trigger catcher guide groove 12*b* overlap each other. Then, the locking piece 18*b* of the trigger catcher 18 (see FIG. 3(*b*)) rotates in such a manner as to enter the locking slit 14*a*-2 of the trigger catcher guide slit 14*a* and the locking groove 12*b*-2 of the trigger catcher guide groove 12*b*. As the compression coil spring 21 pushes the trigger pusher 19 in the closing direction, the locking piece 18*b* of the trigger catcher 18 is kept fitted in the locking slit 14*a*-2 and the locking groove 12*b*-2 so that the first slider 14-1 is maintained at the lock position.

In the first slider 14-1, a guide bar 14*c* is formed for guiding the trigger pusher 19 to be slidable. In the first slider 14-1, a projection 14*d* is formed which is fit inside the compression coil spring 21. At the end in the opening direction of the first slider 14-1, a connection slit 14*e* is formed which is connected to the tip end of the rod 24*b* of the linear damper 24. As illustrated in FIG. 3(*a*), a stop ring 24*c* is mounted on a tip end of the rod 24*b*. The rod 24*b* and the first slider 14-1 are connected to each other by fitting the stop ring 24*c* on the connection slit 14*e*.

Figure 13A:
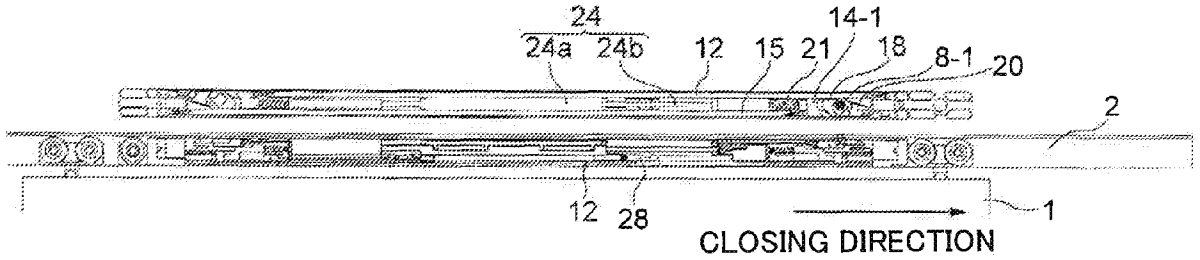
FIGS. 13(*a*) to 13(*c*) are plan views for explaining operation of the retracting device when a sliding door gets closed (FIG. 13(*a*) illustrates the retracting device when retracting operation starts, FIG. 13(*b*) illustrates the retracting device when dampers are switched, and FIG. 13(*c*) illustrates the retracting device when the sliding door is fully closed).
Figure 13B:
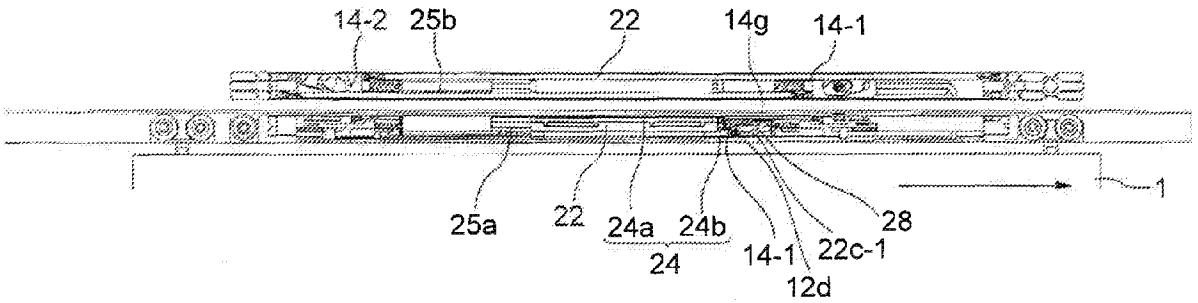
Figure 13C:
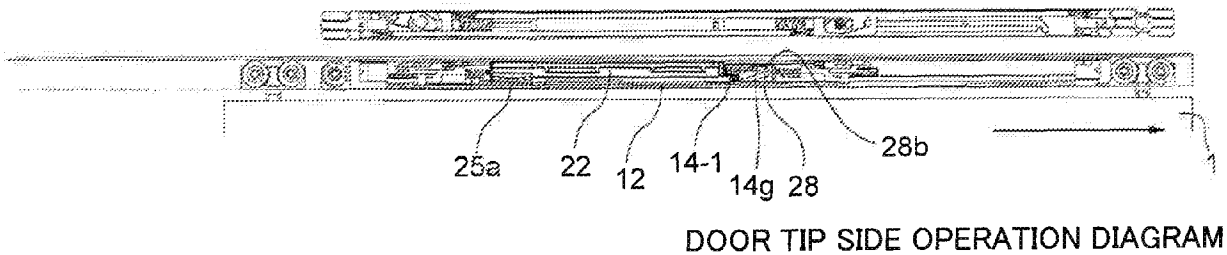

As illustrated in FIG. 6(*b*), at the end in the opening direction of the first slider 14-1, an operation piece 14*f* is formed that abuts to the damper lock 28 to rotate the damper lock 28 (see FIG. 13(*b*)). In the bottom surface of the first slider 14-1, a recess 14*g* is formed for allowing rotation of the damper lock 28 by the operation piece 14*f*.

Figure 7A:
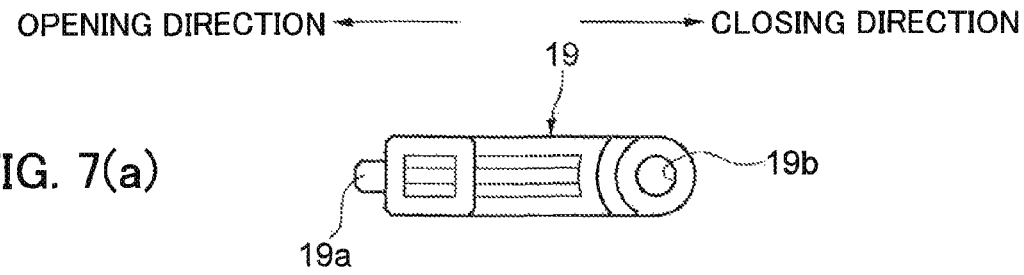
FIGS. 7(*a*) and 7(*b*) illustrate a trigger pusher (FIG. 7(*a*) is a plan view and FIG. 7(*b*) is a side view).
Figure 7B:
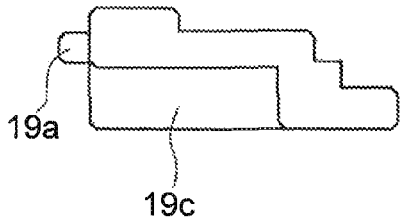
Figure 8A:
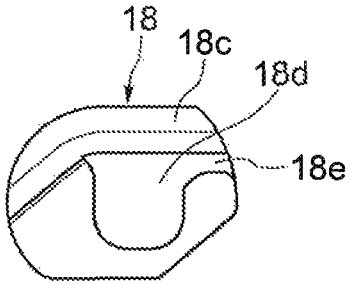
FIGS. 8(*a*) to 8(*d*) illustrate a trigger catcher (FIG. 8(*a*) is a plan view, FIG. 8(*b*) is a side view, FIG. 8(*c*) is a bottom view, and FIG. 8(*d*) is a front view).
Figure 8D:
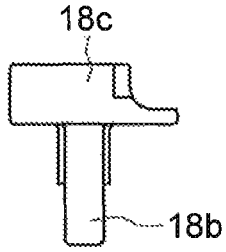
Figure 8B:
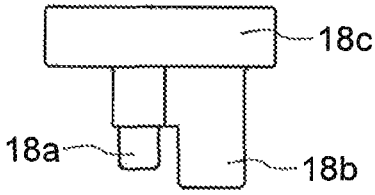
Figure 8C:
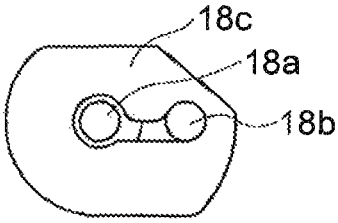

FIGS. 7(*a*) and 7(*b*) illustrate the trigger pusher 19. FIG. 7(*a*) is a plan view and FIG. 7(*b*) is a side view. At the end in the opening direction of the trigger pusher 19, a projection 19*a* is formed that is fit inside the compression coil spring 21. At the end in the closing direction of the trigger pusher 19, a hole 19*b* is formed. In this hole 19*b*, the rotation shaft 18*a* of the trigger catcher 18 is fit rotatably. At the bottom side of the trigger pusher 19, a guide wall 19*c* is formed which is guided by the guide bar 14*c* of the first slider 14-1.

FIGS. 8(*a*) to 8(*d*) illustrate the trigger catcher 18. FIG. 8(*a*) is a plan view, FIG. 8(*b*) is a side view, FIG. 8(*c*) is a bottom view, and FIG. 8(*d*) is a front view. The trigger catcher 18 has a disc-shaped main body 18*c*, the rotation shaft 18*a* projecting downward from the main body 18*c*, and the locking piece 18*b* that is provided in adjacent to the rotation shaft 18*a*. In an upper surface of the main body 18*c*, a trigger pin insert groove 18*d* is formed for inserting the first trigger pin 8-1 therein. The trigger pin insert groove 18*d* is surrounded by a wall, in a part of which an inlet part 18*e* is formed for insertion of the first trigger pin 8-1. The rotation shaft 18*a* and the locking piece 18*b* of the trigger catcher 18 are fit in the trigger catcher guide groove 12*b* of the base 12.

Figure 9A:
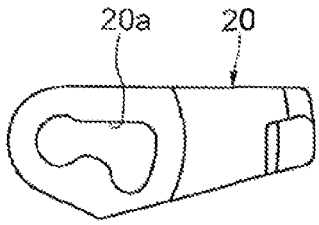
FIGS. 9(*a*) to 9(*c*) illustrate a malfunction reset cam (FIG. 9(*a*) is a plan view, FIG. 9(*b*) is a side view, and FIG. 9(*c*) is a front view).
Figure 9B:
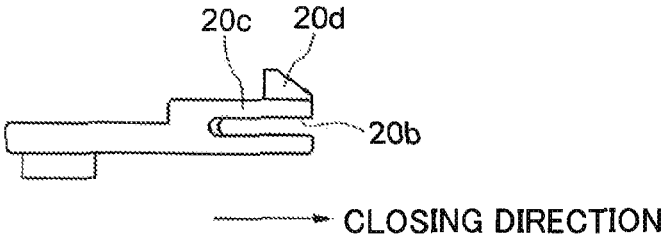
Figure 9C:
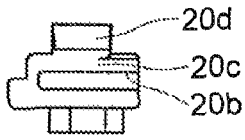

FIGS. 9(*a*) to 9(*c*) illustrate the malfunction reset cam 20. FIG. 9(*a*) is a plan view, FIG. 9(*b*) is a side view, and FIG. 9(*c*) is a front view. Once it is fit in the trigger catcher 18, the malfunction reset cam 20 is supported rotatably, with the trigger catcher 18, by the trigger pusher 19. In the malfunction reset cam 20, a sector-shaped opening 20*a* is formed in which the rotation shaft 18*a* and the locking piece 18*b* of the trigger catcher 18 are fit. This sector-shaped opening 20*a* is formed larger than the rotation shaft 18*a* and the locking piece 18*b* of the trigger catcher 18 in such a manner that rotation of the trigger catcher 18 relative to the malfunction reset cam 20 can be allowed. At the end in the closing direction of the malfunction reset cam 20, a slit 20*b* is formed so that the malfunction reset cam 20 is branched into two vertically. On an upper piece 20*c*, a locking piece 20*d* is formed so as to catch the first trigger pin 8-1.

When the first slider 14-1 is away from the lock position due to malfunction, the inlet part 18*e* of the trigger pin insert groove 18*d* of the trigger catcher 18 cannot accommodate the first trigger pin 8-1. Therefore, even if the sliding door 1 is moved in the closing direction and the first slider 14-1 is close to the first trigger pin 8-1, the trigger catcher 18 cannot catch the first trigger pin 8-1. Even in such a case, the malfunction reset cam 20 catches the first trigger pin 8-1. In other words, the upper piece 20*c* of the malfunction reset cam 20 is bent so that the locking piece 20*d* of the upper piece 20*c* catches the trigger pin 8-1. Therefore, when the sliding door 1 is moved to the fully closed position, the first slider 14-1 can be reset to the lock position.

Figure 10A:
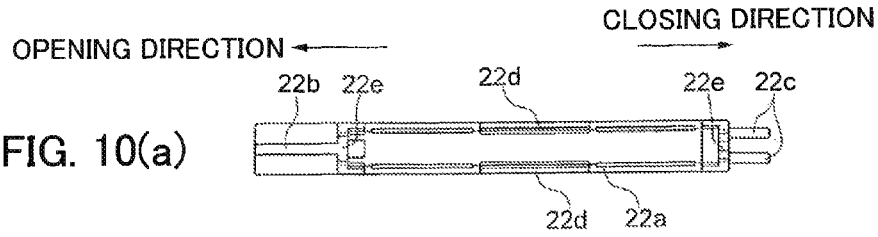
FIGS. 10(*a*) and 10(*b*) illustrate a damper base (FIG. 10(*a*) is a plan view and FIG. 10(*b*) is a side view).
Figure 10B:
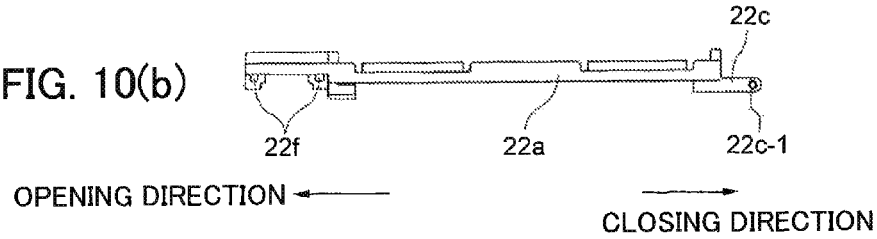

FIGS. 10(*a*) and 10(*b*) illustrate the damper base 22. FIG. 10(*a*) is a plan view and FIG. 10(*b*) is a side view. The damper base 22 has a linear damper fixing part 22*a* where the damper main body 24*a* of the linear damper 24 is mounted, damper lock connection brackets 22*c* provided at the end in the closing direction of the linear damper fixing part 22*a*, and a plate-shaped rotary damper fixing part 22*b* which is provided at the end in the opening direction of the linear damper fixing part 22*a* and where the damper main body 25*a* of the rotary damper 25 is mounted.

At both ends in the width direction of the linear damper fixing part 22*a*, paired claws 22*d* are provided bent inward and the damper main body 24*a* of the linear damper 24 is sandwiched between the paired claws 22*d* in the width direction. At respective ends in the longitudinal direction of the linear damper fixing part 22*a*, paired end walls 22*e* are formed between which the damper main body 24*a* is sandwiched in the longitudinal direction. The damper lock connection brackets 22*c* project from the linear damper fixing part 22*a* in the closing direction. Connected to the damper lock connection brackets 22*c* is the damper lock 28 via a spring pin 22*c*-1 rotatably. The damper lock 28 is biased to the lock hole 12*d* of the base 12 by the spring pins 22*c*-1. At the bottom of the plate-shaped rotary damper fixing part 22*b*, positioning projections 22*f* are formed for positioning the damper main body 25*a* of the rotary damper 25.

Figure 11A:
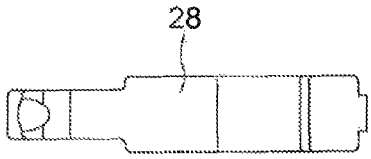
FIGS. 11(*a*) and 11(*b*) illustrate a damper lock (FIG. 11(*a*) is a plan view and FIG. 11(*b*) is a side view).
Figure 11B:
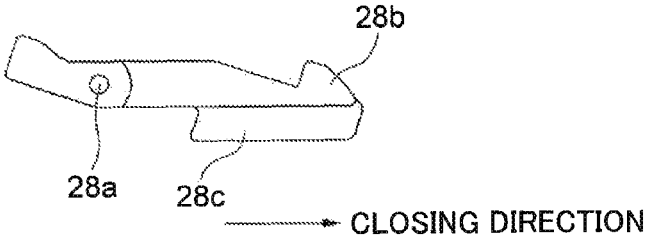

FIGS. 11(*a*) and 11(*b*) illustrate the damper lock 28. FIG. 11(*a*) is a plan view and FIG. 11(*b*) is a side view. The damper lock 28 has a through hole 28*a* formed, into which a spring pin is inserted for connecting the damper lock 28 to the damper base 22. The damper lock 28 rotates in the vertical plane around the through hole 28*a* as a seesaw. On the upper surface at the end in the closing direction of the damper lock 28, a slider side hook 28*b* is formed which engages with a side 14*g*-1 in the opening direction of the recess 14*g* of the first slider 14-1 (see FIG. 6(*b*)). In the lower-side center part of the damper lock 28 in the longitudinal direction, a base side hook 28*c* is formed that engages with a side surface 12*d*-1 in the opening direction of the lock hole 12*d* of the base 12 (see FIG. 5(*d*)).

Figure 12A:
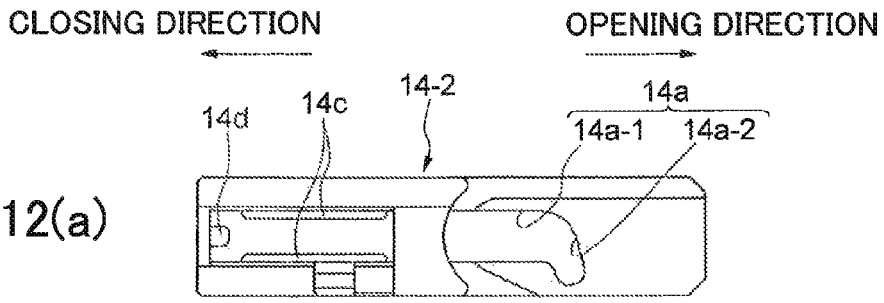
FIGS. 12(*a*) and 12(*b*) illustrate a second slider (FIG. 12(*a*) is a plan view and FIG. 12(*b*) is a side view).
Figure 12B:
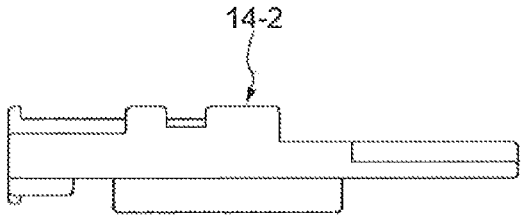

FIGS. 12(*a*) and 12(*b*) are detail views of the second slider 14-2. FIG. 12(*a*) is a plan view and FIG. 12(*b*) is a side view. In the second slider 14-2, the trigger catcher guide slit 14*a* is formed which has a straight slit 14*a*-1 extending in the longitudinal direction to the opening side and a locking slit 14*a*-2 bent to the side at the end in the opening direction of the straight slit 14*a*-1. This trigger catcher guide slit 14*a* corresponds to the left trigger catcher guide groove 12*b* of the base 12 and passes through the second slider 14-2 vertically. In the second slider 14-2, a guide bar 14*c* is formed for guiding the trigger pusher 19 to be slidable. In the second slider 14-2, a projection 14*d* is formed which is fit inside the compression coil spring 21.

As illustrated in FIGS. 3(*a*) and 3(*b*), similarly to the first slider 14-1, the second slider 14-2 is mounted with the trigger pusher 19, the trigger catcher 18, and the malfunction reset cam 20. When the second slider 14-2 reaches the lock position, the trigger catcher guide slit 14*a* and the trigger catcher guide groove 12*b* overlap each other. At this time, the locking piece 18*b* of the trigger catcher 18 rotates in such a manner as to enter the locking slit 14*a*-2 of the trigger catcher guide slit 14*a* and the locking groove 12*b*-2 of the trigger catcher guide groove 12*b*. As the compression coil spring 21 pushes the trigger pusher 19 in the closing direction, the locking piece 18*b* of the trigger catcher 18 is kept fit in the locking slit 14*a*-2 and the locking groove 12*b*-2 so that the second slider 14-2 is maintained at the lock position. When the second slider 14-2 is away from the lock position due to malfunction, the inlet part 18*e* of the trigger pin insert groove 18*d* of the trigger catcher 18 cannot accommodate the second trigger pin 8-2. Therefore, even if the sliding door 1 is moved in the opening direction and the second slider 14-2 is close to the second trigger pin 8-2, the trigger catcher 18 cannot catch the second trigger pin 8-2. Even in such a case, the malfunction reset cam 20 catches the second trigger pin 8-2. When the sliding door is moved to the fully open position, the second slider 14-2 can be reset to the lock position.

As illustrated in FIGS. 3(*a*) and 3(*b*), the slide rack 25*b* and the slide guide 17 are attached to the second slider 14-2. The slide rack 25*b* engages with the pinion of the damper main body 25*a* of the rotary damper 25. The slide rack 25*b* and the slide guide 17 are slidable, with the second slider 14-2, relative to the base 12. When the second slider 14-2 moves relatively toward the damper base 22 due to the biasing force of the pulling coil spring 16, the pinion of the damper main body 25*a* of the rotary damper 25 rotates to cause a damping force.

Next description is made about the operation of the retracting device 4 when the sliding door 1 gets closed. FIG. 13(*a*) illustrates the retracting device 4 when the retracting operation starts, FIG. 13(*b*) illustrates the retracting device 4 when the dampers are switched, and FIG. 13(*c*) illustrates the retracting device 4 when the sliding door 1 is fully closed. FIGS. 13(*a*) to 13(*c*) at the top stage are plan views and at the bottom stage are cross sectional views.

When the sliding door 1 is moved in the closing direction manually, the retracting device 4 moves in the closing direction together with the sliding door 1. As illustrated in FIG. 13(*a*), when the first slider 14-1 reaches the retracting start position, the trigger catcher 18 abuts to the first trigger pin 8-1. Then, the trigger catcher 18 rotates to catch the first trigger pin 8-1 and the first slider 14-1 becomes slidable relative to the base 12. As the pulling coil spring 15 is provided between the first slider 14-1 and the base 12, it causes such a pulling force as to slide the first slider 14-1. As the trigger catcher 18 catches the first trigger pin 8-1 fixed to the guide rail 2, the base 12 moves in the closing direction without movement of the trigger catcher 18.

With movement of the base 12 in the closing direction, the sliding door 1 starts to move in the closing direction, and therefore, the manual force for closing the sliding door 1 is reduced. As the damper base 22 is engaging with the base 12 by the damper lock 28 for the first slider, the damper base 22 also moves in the closing direction relative to the first slider 14-1. Therefore, a distance between the damper base 22 and the first slider 14-1 reduces and the rod 24*b* is inserted into the damper main body 24*a* of the linear damper 24. As a result, the linear damper 24 causes a damping force. As the linear damper 24 operates at the initial operation time where the spring force of the pulling coil spring 15 is large and the larger damping force is generated, movement of the sliding door 1 can be smoothed.

As illustrated in FIG. 13(*b*), when the base 12 reaches the damper switching position, the rod 24*b* is accommodated in the damper main body 24*a* completely and the damping force due to the linear damper 24 disappears. At the same time, the first slider 14-1 rotates the damper lock 28 against the spring force of the spring pin 22*c*-1 and engagement between the damper lock 28 and the base 12 is released. The rotated damper lock 28 enters the recess 14*g* of the first slider 14-1 and only the base 12 starts to move in the closing direction of the sliding door 1 relative to the first slider 14-1 and the damper base 22 abutting to the first slider 14-1. As a result, the distance between the second slider 14-2 engaging with the base 12 and the damper base 22 reduces. At the end in the opening direction of the damper base 22, the damper main body 25*a* of the rotary damper 25 is provided. Because the second slider 14-2 is provided with the slide rack 25*b* which engages with the pinion of the damper main body 25*a*, the rotary damper 25 rotates when the distance between the second slider 14-2 and the damper base 22 reduces. The rotation of the rotary damper 25 causes a damping force. Even after the operation of the linear damper 24, it is switched to the rotary damper 25 and the rotary damper 25 causes a damping force until the sliding door 1 is fully closed. This makes it possible to prevent occurrence of the impact and noise during the full closing operation. As the pulling force of the pulling coil spring 15 becomes small at a last half of the retracting operation, it does not matter if the damping force generated by the rotary damper 25 is small. Finally, as illustrated in FIG. 13(*c*), the sliding door 1 is fully closed.

By providing the damper lock 28 for the first slider and capable of engaging with the base 12 to the damper base 22 in the exemplary embodiment, the linear damper 24 can operate first and then the rotary damper 25 can operate. If the damper base 22 is not provided with the damper lock 28 for the first slider, it is uncertain which of the linear damper 24 or the rotary damper 25 operates first unless the damping force of the linear damper 24 and the damping force of the rotary damper 25 are different from each other. By providing the damper lock 28 for the first slider to the damper base 22, it is possible to eliminate such uncertainty.

Figure 14:
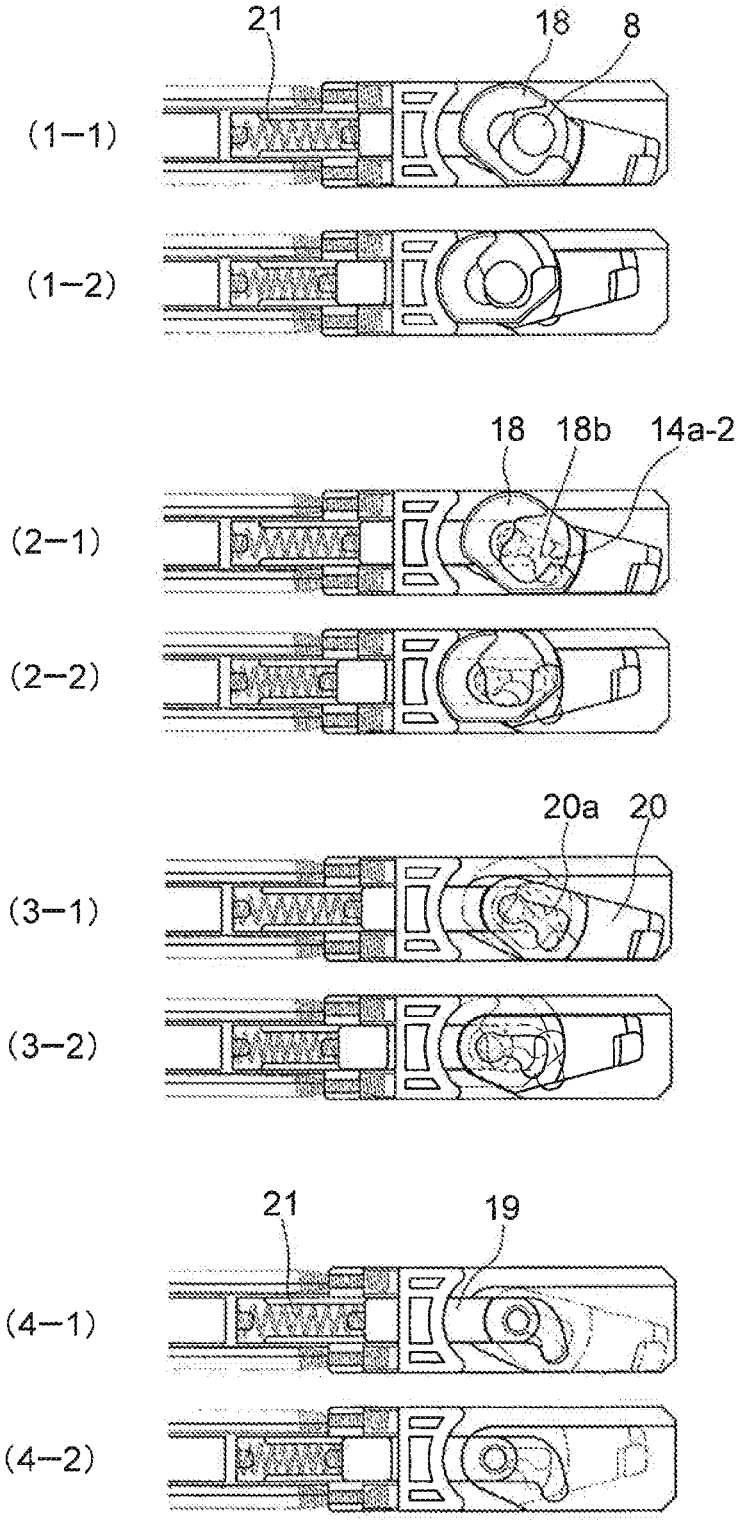
FIGS. 14 (1-1) to 14 (4-2) are detail views in which the trigger catcher rotates to allow sliding.

FIGS. 14(1-1) to 14(4-2) are detail views in which the trigger catcher 18 rotates to release the lock of the first slider to allow sliding. FIGS. 14(1-1), (2-1), (3-1), and (4-1) illustrate the trigger catcher 18 before it rotates and FIGS. 14(1-2), (2-2), (3-2), and (4-2) illustrate the trigger catcher 18 after it has rotated. FIGS. 14(1-1) and (1-2) are plan views of the trigger pin 8 and the trigger catcher 18, FIGS. 14(2-1) and (2-2) are plan views of the trigger catcher 18, FIGS. 14(3-1) and (3-2) illustrate a state where the trigger catcher 18 is removed, and FIGS. 14(4-1) and (4-2) illustrate a state where the trigger catcher 18 and the malfunction reset cam 20 are removed.

As illustrated in FIGS. 14(1-1) and (1-2), when the trigger pin 8 abuts to the trigger catcher 18, the trigger catcher 18 rotates. As illustrated in FIGS. 14(2-1) and (2-2), with rotation of the trigger catcher 18, the locking piece 18*b* of the trigger catcher 18 gets out of the locking slit 14*a*-2 of the first slider 14-1 and the locking groove 12*b*-2 of the base 12. As illustrated in FIGS. 14(3-1) and (3-2), with rotation of the trigger catcher 18, the malfunction reset cam 20 rotates. Because the open angle of the sector-shaped opening 20*a* of the malfunction reset cam 20 is larger than the locking piece 18*b*, the rotation angle of the malfunction reset cam 20 becomes smaller than the trigger catcher 18. Accordingly, if the malfunction reset cam 20 rotates, it does not run off the first slider 14-1. As illustrated in FIGS. 14(4-1) and (4-2), with rotation of the trigger catcher 18, the trigger pusher 19 that supports the rotation shaft 18*a* of the trigger catcher 18 goes back to the direction opposite to the closing direction and shortens the compression coil spring 21.

Next description is made about the operation of the retracting device 4 when the fully-closed sliding door opens. As illustrated in FIG. 13(*c*), when the sliding door 1 is fully closed, the damper lock 28 is fit in the recess 14*g* of the first slider 14-1. When the sliding door 1 starts to open, the slider side hook 28*b* of the damper lock 28 engages with the recess 14*g* of the first slider 14-1 and therefore the first slider 14-1 and the damper base 22 engage with each other. As a result, only the base 12 moves in the opening direction relative to the first slider 14-1 and the damper base 22. At this time, the pinion of the damper main body 25*a* of the rotary damper 25 rotates while it engages with the slide rack 25*b* locked to the base 12 via the second slider 14-2. As the rotary damper 25 is set not to cause the damping force in the rotational direction when the sliding door 1 opens, the load applied when opening the sliding door 1 is only an elastic force that is generated by extending of the pulling coil spring 15.

As illustrated in FIG. 13(*b*), when the lock hole 12*d* of the base 12 moves to the damper lock position, the base side hook 28*c* (see FIG. 11(*b*)) of the damper lock 28 is fit in the lock hole 12*d* by the spring force of the spring pin 22*c*-1 and the damper base 22 moves integrally with the base 12. After that, as the base 12 and the damper base 22 move in the opening direction of the sliding door 1, the rod 24*b* is drawn from the damper main body 24*a* of the linear damper 24.

As illustrated in FIG. 13(*a*), when the rod 24*b* is completely drawn from the damper main body 24*a* of the linear damper 24 and the first slider 14-1 moves up to the lock position of the base 12, the trigger catcher 18 and the malfunction reset cam 20 rotate by the elastic force of the compression coil spring 21 and the first slider 14-1 is fixed to the lock position. Then, as the trigger catcher 18 releases the first trigger pin 8-1, the sliding door is moved in the opening direction without operating of the retracting device 4 after that.

Figure 15A:
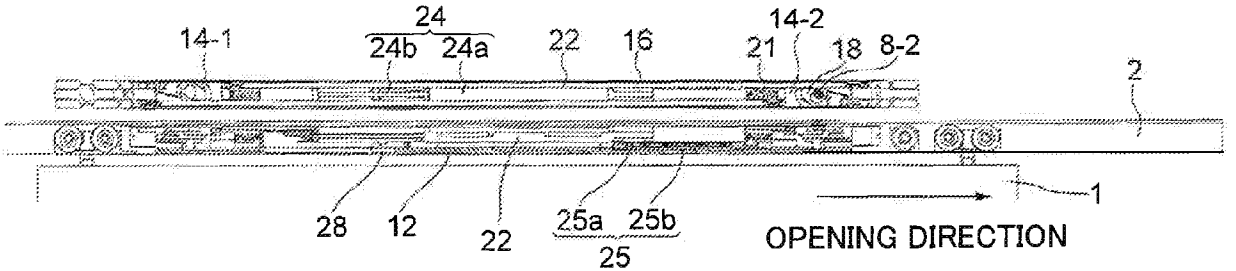
FIGS. 15(*a*) to 15(*c*) are plan views for explaining the operation of the retracting device when the sliding door gets open (FIG. 15(*a*) illustrates the retracting device when the retracting operation starts, FIG. 15(*b*) illustrates the retracting device when the dampers are switched, and FIG. 15(*c*) illustrates the retracting device when the sliding door is fully open).
Figure 15B:
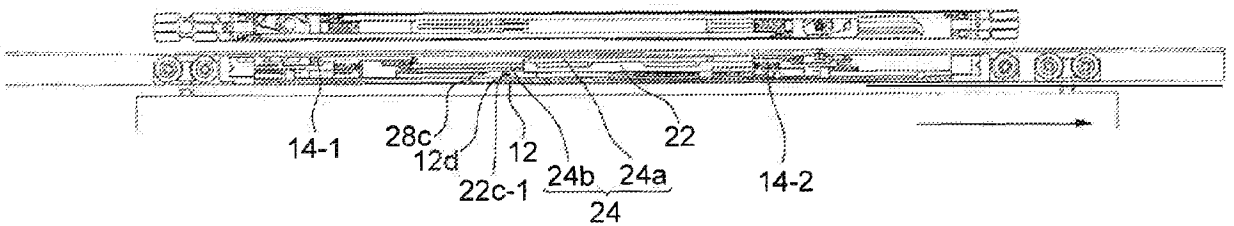
Figure 15C:
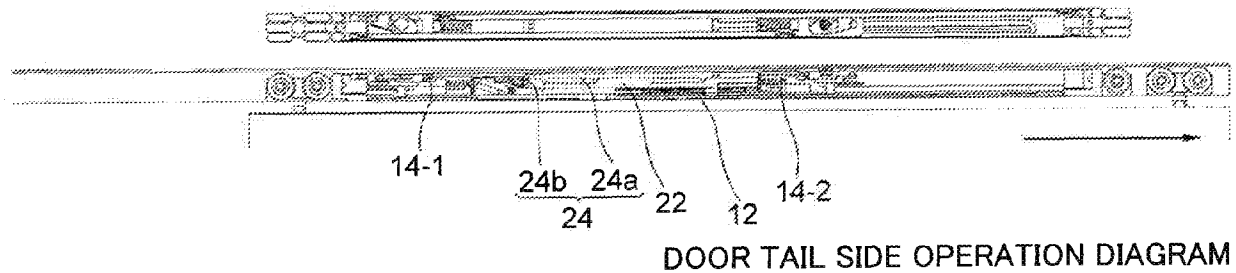

Next description is made about the operation of the retracting device 4 when the sliding door 1 opens. FIG. 15(*a*) illustrates the retracting device when the retracting operation starts, FIG. 15(*b*) illustrates the retracting device when the dampers are switched, and FIG. 15(*c*) illustrates the retracting device when the sliding door is fully open. FIGS. 15(*a*) to 15(*c*) at the top stage are plan views and at the bottom stage are cross sectional views. Rightward directions in FIGS. 15(*a*) to 15(*c*) are opening directions. FIGS. 15(*a*) to 15(*c*) illustrate the retracting device 4 seen from an opposite side from FIGS. 13(*a*) to 13(*c*).

When the sliding door 1 is moved in the opening direction manually, the retracting device 4 moves in the opening direction together with the sliding door 1. As illustrated in FIG. 15(*a*), when the second slider 14-2 reaches the retracting start position, the trigger catcher 18 abuts to the second trigger pin 8-2. Then, the trigger catcher 18 rotates to catch the second trigger pin 8-2 and the second slider 14-2 becomes slidable relative to the base 12. As the pulling coil spring 16 is provided between the second slider 14-2 and the base 12, it causes such a pulling force as to slide the second slider 14-2. As the trigger catcher 18 catches the second trigger pin 8-2 fixed to the guide rail 2, the base 12 moves in the opening direction without movement of the trigger catcher 18. With movement of the base 12 in the opening direction, the sliding door 1 starts to move in the opening direction, and therefore, the manual force for opening the sliding door 1 is reduced.

When the base 12 moves in the opening direction, the damper lock 28 for the first slider of the damper base 22 is free relative to the base 12 and the damper base 22 is slidable relative to the base 12. In other words, the damper lock 28 for the first slider does not engage the base 12 and the damper base 22 with each other when the base 12 moves in the opening direction. Therefore, the linear damper 24 can operate or the rotary damper 25 can operate first. In this exemplary embodiment, however, the damping force of the rotary damper 25 is set to be smaller than the damping force of the linear damper 24 and therefore the rotary damper 25 operates first. In other words, the damper base 22 moves with the base 12 in the opening direction and a distance between the damper base 22 and the second slider 14-2 reduces.

As illustrated in FIG. 15(*b*), when the base 12 reaches the damper switching position, the damper base 22 abuts to the second slider 14-2 and the damping force due to the rotary damper 25 disappears. After the damper base 22 abuts to the second slider 14-2, only the base 12 moves in the opening direction relative to the second slider 14-2 and the damper base 22. Because the first slider 14-1 is locked to the base 12, as the base 12 moves in the opening direction, the distance between the first slider 14-1 and the damper base 22 reduces. As the linear damper 24 is provided over between the first slider 14-1 and the damper base 22, the rod 24*b* of the linear damper 24 is accommodated in the damper main body 24*a* and the linear damper 24 causes a damping force. The linear damper 24 generates the damping force until the sliding door 1 comes into the fully open state.

Next description is made about the operation of the retracting device 4 when the fully-open sliding door 1 closes. As illustrated in FIG. 15(*c*), when the sliding door 1 starts to close, the first slider 14-1 and the base 12 move in the opening direction relative to the damper base 22 and the second slider 14-2. At this time, the rod 24*b* of the linear damper 24 is drawn out. As shown in FIG. 15(*b*), if the lock hole 12*d* of the base 12 moves to the damper lock position, the base side hook 28*c* of the damper lock 28 is fit in the lock hole 12*d* by the spring force of the spring pin 22*c*-1 and the damper base 22 moves integrally with the base 12. As the base 12 and the damper base 22 move in the opening direction relative to the second slider 14-2, the damper main body 25*a* of the rotary damper 25 fixed to the damper base 22 rotates. As illustrated in FIG. 15(*a*), when the second slider 14-2 moves up to the lock position of the base 12, the trigger catcher 18 and the malfunction reset cam 20 rotate by the elastic force of the compression coil spring 21 and the second slider 14-2 is fixed to the lock position. Then, as the trigger catcher 18 releases the second trigger pin 8-2, the sliding door is moved in the closing direction without operating of the retracting device 4 after that.

Figure 16A:
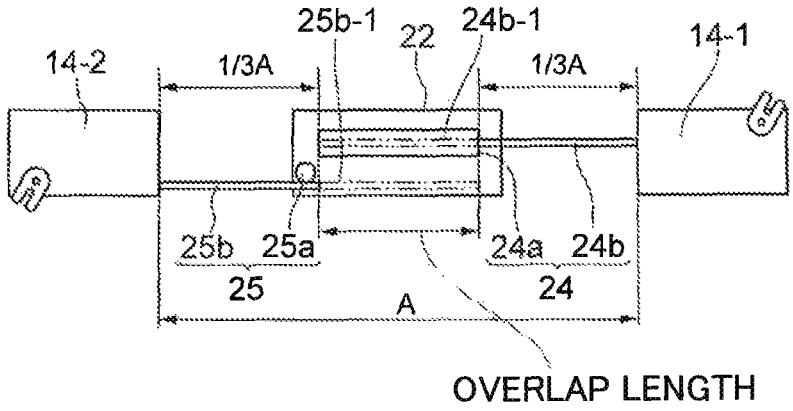
FIGS. 16(*a*) and 16(*b*) are views for comparing strokes of the dampers (FIG. 16(*a*) is a schematic diagram of the retracting device according to the exemplary embodiment and FIG. 16(*b*) is a schematic diagram of a conventional retracting device).
Figure 16B:
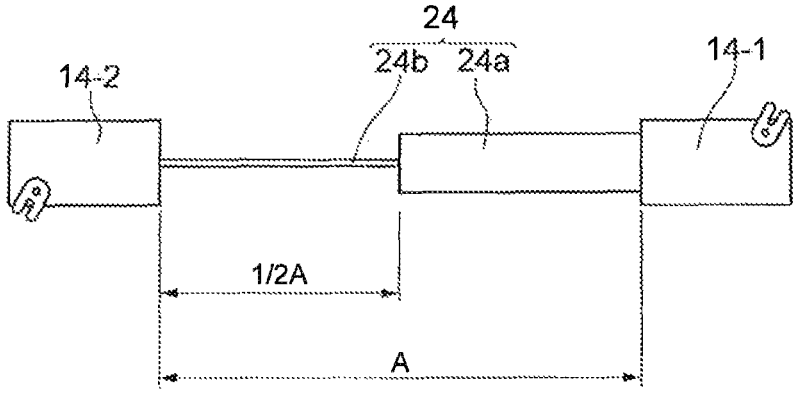

FIG. 16(*a*) is a schematic diagram of the retracting device 4 according to the exemplary embodiment and FIG. 16(*b*) is a schematic diagram of a retracting device according to a comparative example. As illustrated in FIG. 16(*a*), the linear damper 24 is provided over between the damper base 22 slidable relative to the base 12 and the first slider 14-1 and the rotary damper 25 is provided over between the damper base 22 and the second slider 14-2. When the distance between the first slider 14-1 and the damper base 22 reduces and the distance between the second slider 14-2 and the damper base 22 reduces, the rod 24*b*-1 (illustrated in two-dot chain lines in the drawing) of the linear damper 24 and the slide rack 25*b*-1 (illustrated in two-dot chain lines in the drawing) of the rotary damper 25 overlap each other by a predetermined length in the longitudinal direction of the base 12. If the distance between the first slider 14-1 and the second slider 14-2 is A, a stroke of the linear damper 24 is ⅓A and a stroke of the rotary damper 25 is ⅓A. Therefore, the sum of the strokes of the dampers may be ⅔A at the maximum. This is the same, if the linear damper 24 is used in place of the rotary damper 25.

On the other hand, as illustrated in FIG. 16(*b*), if the linear damper 24 is provided over between the first slider 14-1 and the second slider 14-2, a stroke of the linear damper 24 is ½A and the stroke of the entire linear damper 24 is small.

Figure 17A:
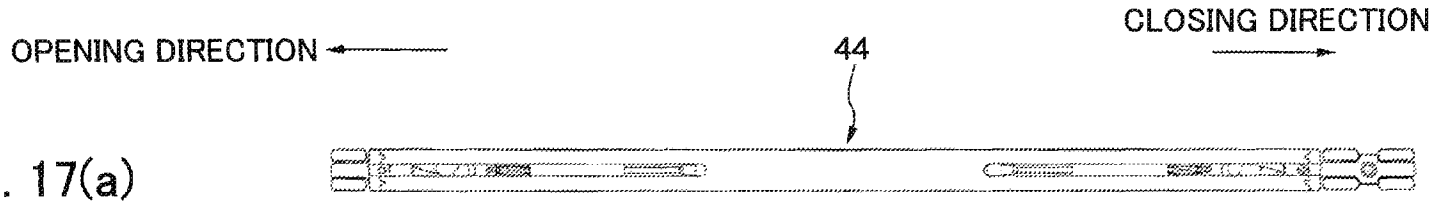
FIGS. 17(*a*) and 17(*b*) are outline views of a retracting device according to a second exemplary embodiment of the invention (FIG. 17(*a*) is a plan view and FIG. 17(*b*) is a side view).
Figure 17B:
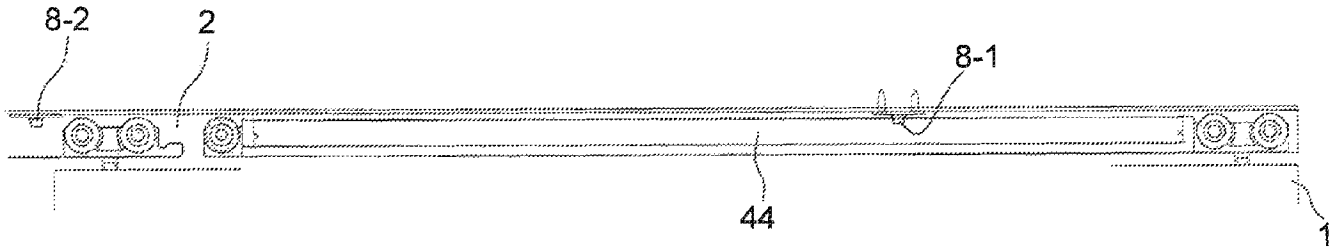

FIGS. 17(*a*) and 17(*b*) are outline views of a retracting device 44 according to a second exemplary embodiment of the invention. FIG. 17(*a*) is a plan view and FIG. 17(*b*) is a side view. An elongating retracting device 44 is inserted into a guide rail 2. Similarly to the retracting device 4 according to the first exemplary embodiment, a first trigger pin 8-1 for assisting closing operation of a sliding door 1 and a second trigger pin 8-2 for assisting opening operation of the sliding door 1 are mounted to an upper part of the guide rail 2 at an interval in a longitudinal direction of a guide rail 2.

Figure 18A:
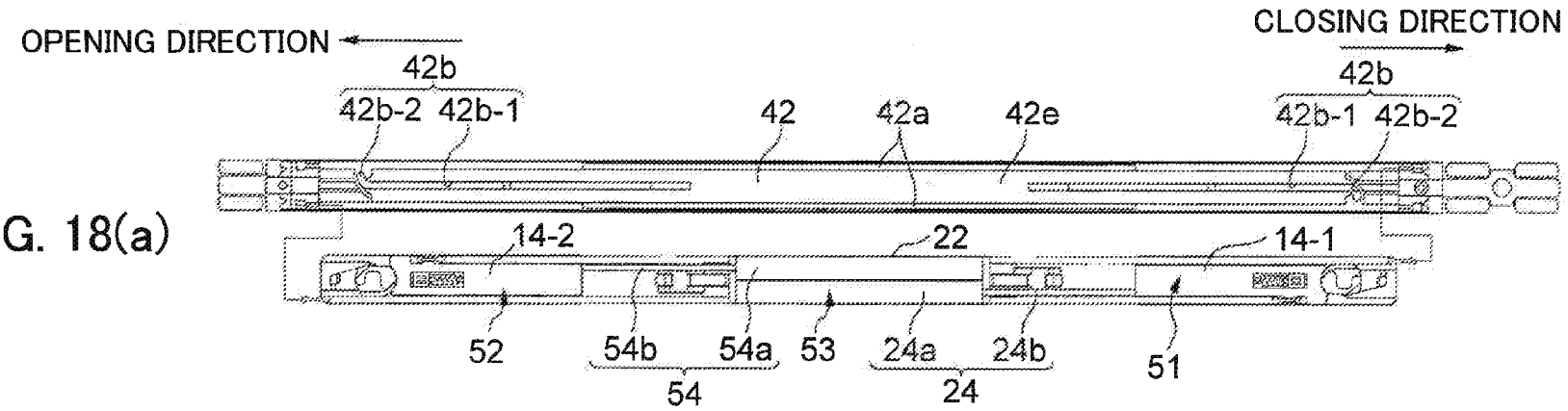
FIGS. 18(*a*) and 18(*b*) are exploded views of the retracting device according to the second exemplary embodiment of the invention (FIG. 18(*a*) is a plan view and FIG. 18(*b*) is a vertical cross sectional view along opening and closing directions).
Figure 18B:
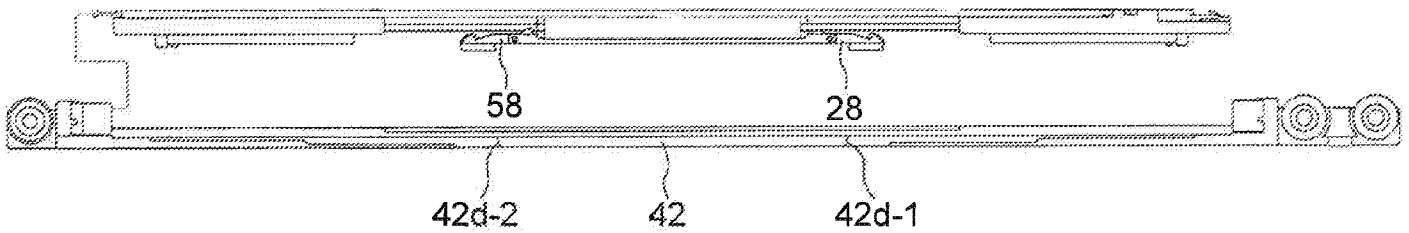

FIGS. 18(*a*) and 18(*b*) are exploded views of the retracting device 44 according to the second exemplary embodiment. FIGS. 18(*a*) and 18(*b*) illustrate a state where first and second slider assemblies 51 and 52 and a damper assembly 53 are detached from a base 42. FIG. 18(*a*) is a plan view and FIG. 18(*b*) is a vertical cross sectional view along opening and closing directions.

Similarly to the retracting device 4 according to the first exemplary embodiment, the retracting device 44 according to the second exemplary embodiment has the base 42 elongating in the opening and closing directions, the first and second slider assemblies 51 and 52 provided to both ends in the longitudinal direction of the base 42, and the damper assembly 53 disposed between the first slider assembly 51 and the second slider assembly 52. The first slider assembly 51 assists the closing operation of the sliding door 1 and the second slider assembly 52 assists the opening operation of the sliding door. The damper assembly 53 damps the closing operation and the opening operation of the sliding door 1. A structure of the first slider assembly 51 is approximately the same as that of the retracting device 4 according to the first exemplary embodiment and provided with the same reference numerals to omit description of the structure. Between the first slider 14-1 and the damper base 22, a linear damper 24 is provided over as a first damper as in the retracting device 4 according to the first exemplary embodiment. However, unlike in the retracting device 4 according to the first exemplary embodiment, a linear damper 54 is provided as a second damper over between the second slider 14-2 and the damper base 22. Damping forces of the two linear dampers 24 and 54 are approximately equal to each other. Not only a damper lock 28 for the first slider but also a damper lock 58 for the second slider are provided to the damper base 22.

Figure 19A:
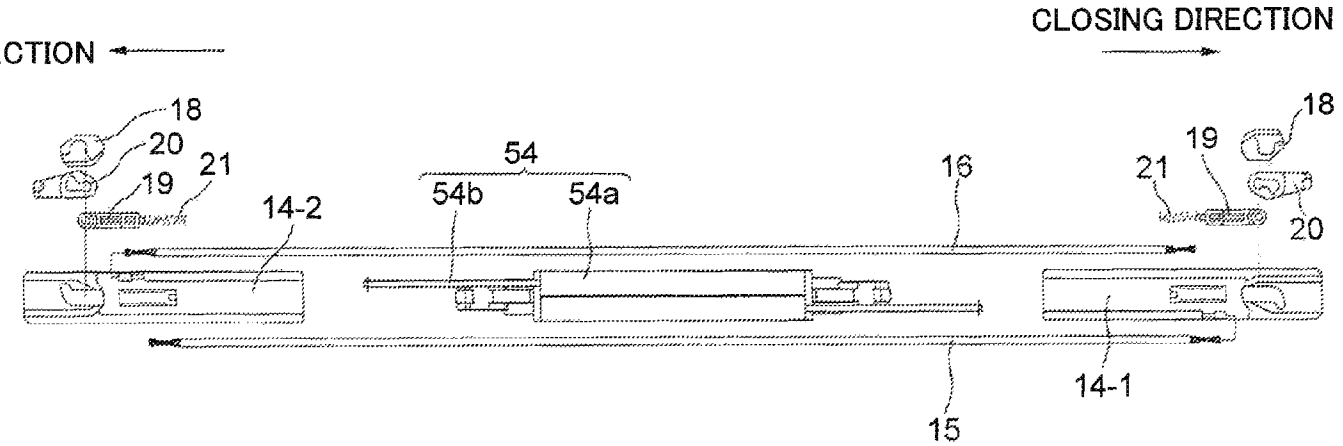
FIGS. 19(*a*) and 19(*b*) are exploded views of the retracting device according to the second exemplary embodiment of the invention (FIG. 19(*a*) is a plan view and FIG. 19(*b*) is a side view).
Figure 19B:
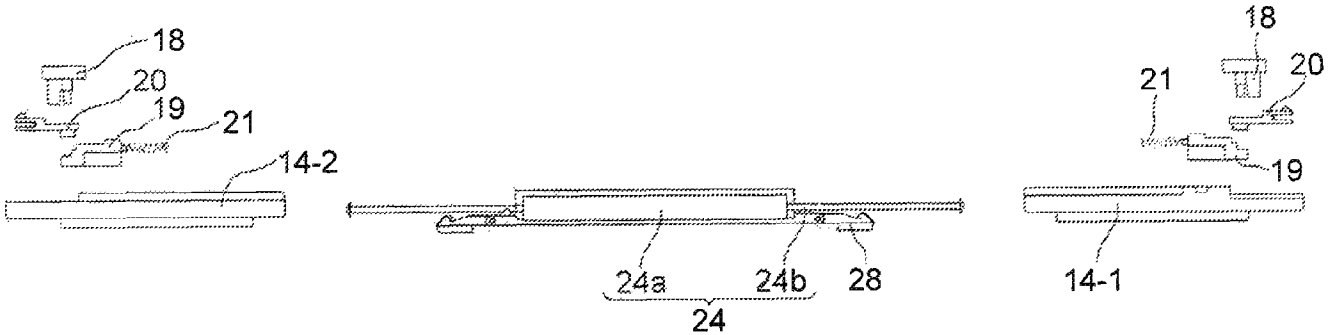

FIGS. 19(*a*) and 19(*b*) are exploded views of the first and second slider assemblies 51 and 52 and the damper assembly 53. FIG. 19(*a*) is a plan view and FIG. 19(*b*) is a side view. The second slider assembly 52 has approximately the same structure as the second slider assembly 32 of the retracting device 4 according to the first exemplary embodiment. In other words, the second slider assembly 52 includes the second slider 14-2, a trigger catcher 18, a trigger pusher 19, a malfunction reset cam 20, and a compression coil spring 21. Structures of the respective parts are approximately the same as those of the second slider assembly 32 and provided with the same reference numerals to omit description of the structures.

As illustrated in FIG. 18(*a*), in a bottom wall 42*e* of the base 42, a left trigger catcher guide groove 12*b* and a right trigger catcher guide groove 42*b* are formed to be symmetric with respect to a point. Each of the trigger catcher guide grooves 42*b* includes a straight groove 42*b*-1 and a locking groove 42*b*-2 bent to one side at the end in the closing direction or the opening direction of the straight groove 42*b*-1. The first slider 14-1 is at a lock position at the end in the closing direction of the base 42 and the second slider 14-2 is at a lock position at the end in the opening direction of the base 42.

As illustrated in FIGS. 18(*a*) and 18(*b*), the damper assembly 53 is mounted to be slidable in the longitudinal direction between paired side walls 42*a* of the base 42. Between the damper base 22 and the first slider 14-1, a linear damper 24 is provided over as a first damper. A damper main body 24*a* of the linear damper 24 is mounted to the damper base 22 and a tip end of a rod 24*b* of the linear damper 24 is mounted to the first slider 14-1. Between the damper base 22 and the second slider 14-2, the linear damper 54 is provided over as the second damper. A damper main body 54*a* of the linear damper 54 is mounted to the damper base 22 and a tip end of a rod 54*b* of the linear damper 54 is mounted to the second slider 14-2.

Figures 20A, 20B:
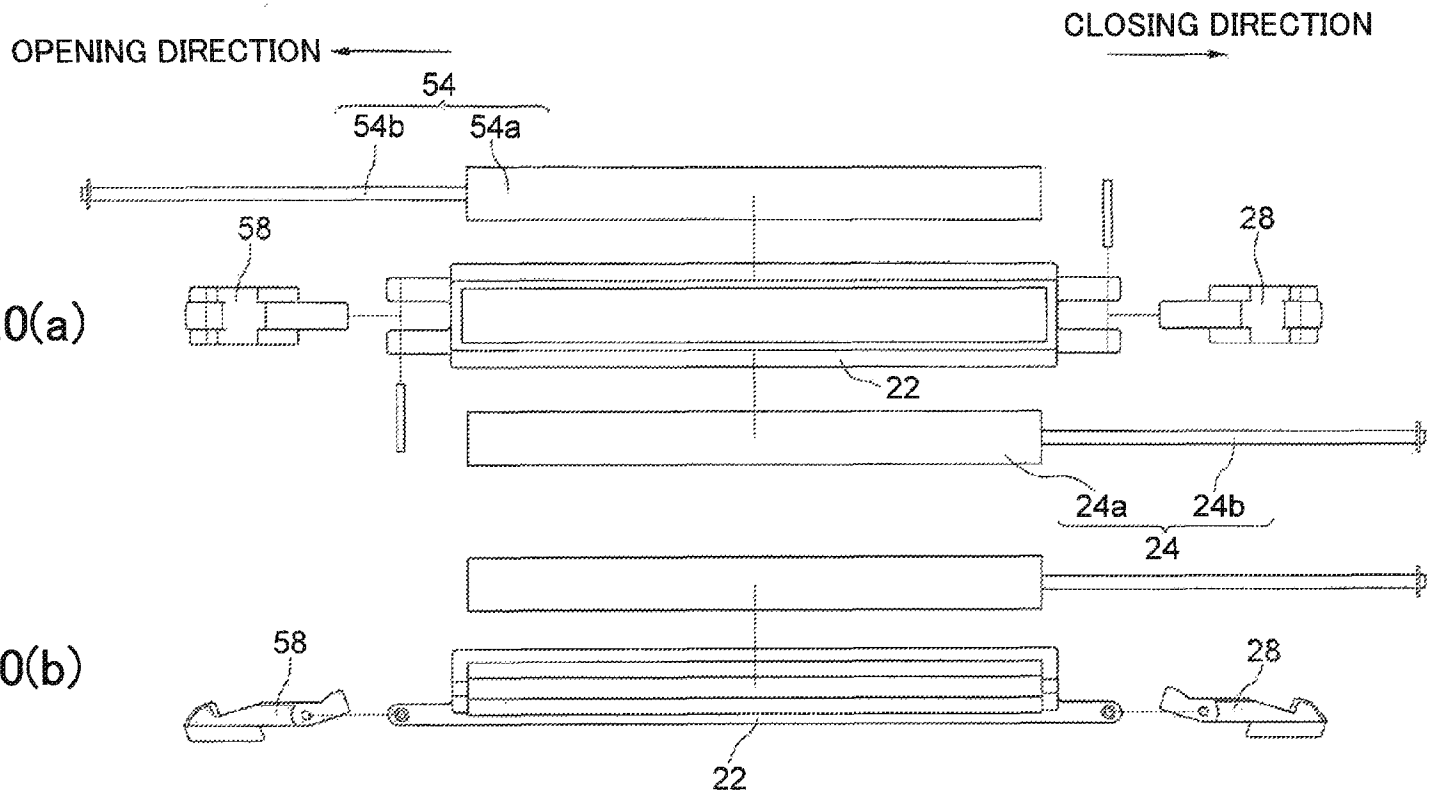
FIGS. 20(*a*) and 20(*b*) are exploded views of a damper assembly (FIG. 20(*a*) is a plan view and FIG. 20(*b*) is a side view).

FIGS. 20(*a*) and 20(*b*) are exploded views of a damper assembly 53. FIG. 20(*a*) is a plan view and FIG. 20(*b*) is a side view. To the damper base 22, the damper main body 24*a* of the linear damper 24 and the damper main body 54*a* of the linear damper 54 are mounted in adjacent to each other in a width direction. At the end of the damper base 22 in the closing direction, a damper lock 28 for the first slider is attached thereto to be rotatable in the vertical plane. At the end of the damper base 22 in the opening direction, a damper lock 58 for the second slider is attached thereto to be rotatable in the vertical plane. In the base 42, a lock hole 42*d*-1 is formed as a damper lock engaging piece for engagement of the damper lock 28 for the first slider therein (see FIG. 18(*b*)) and a lock hole 42*d*-2 is formed as a damper lock engaging piece for engagement of the damper lock 58 for the second slider therein.

Figures 21A, 21B, 21C:
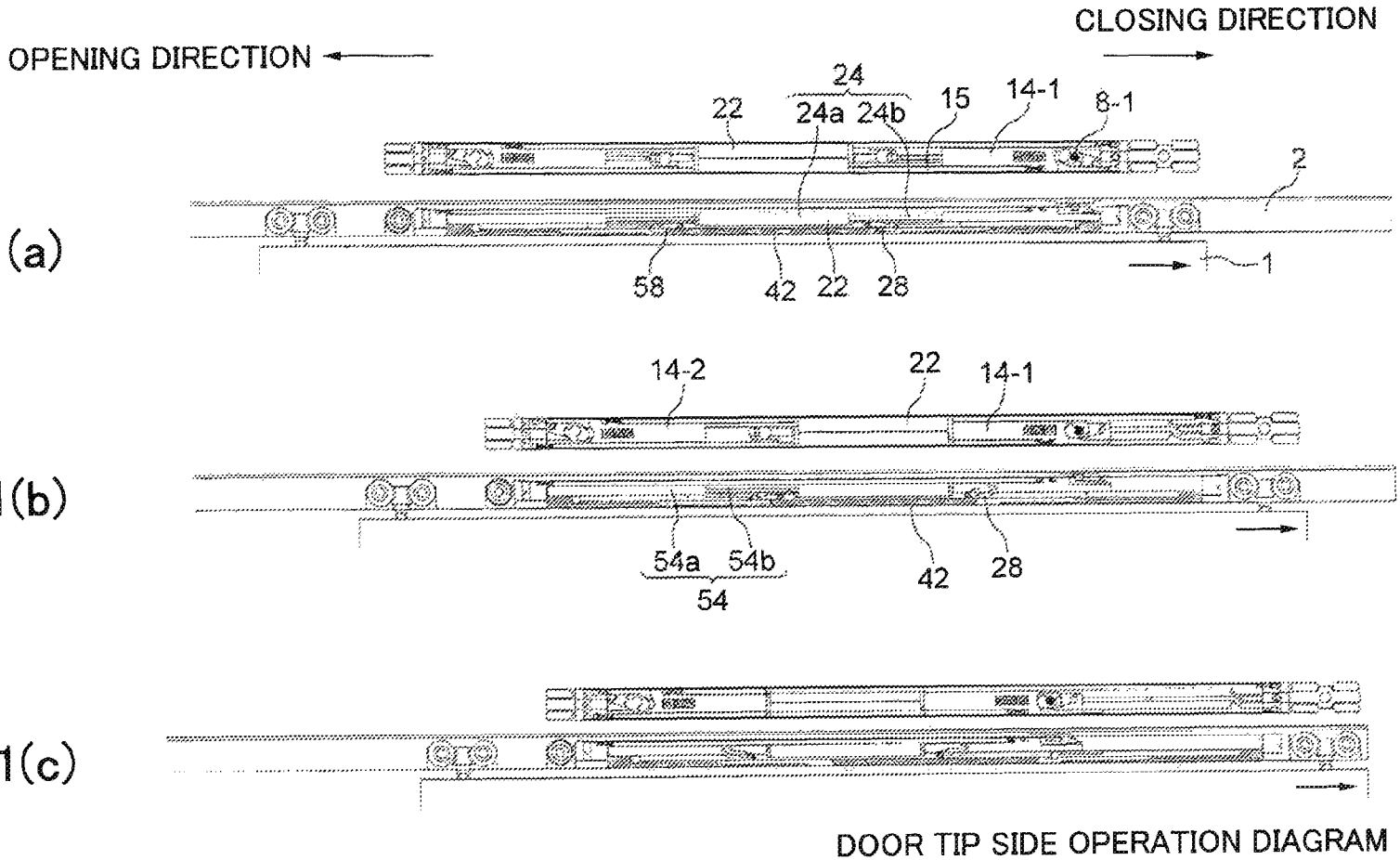
FIGS. 21(*a*) to 21(*c*) are plan and side views for explaining operation of the retracting device according to the second exemplary embodiment when a sliding door gets closed (FIG. 21(*a*) illustrates the retracting device when the retracting operation starts, FIG. 21(*b*) illustrates the retracting device when dampers are switched, and FIG. 21(*c*) illustrates the retracting device when the sliding door is fully closed).

Next description is made about the operation of the retracting device 44 according to the second exemplary embodiment when the sliding door 1 gets closed. FIG. 21(*a*) illustrates the retracting device 44 when the retracting operation starts, FIG. 21(*b*) illustrates the retracting device 44 when the dampers are switched, and FIG. 21(*c*) illustrates the retracting device 44 when the sliding door 1 is fully closed. FIGS. 21(*a*) to 21(*c*) at the top stage are plan views and at the bottom stage are cross sectional views.

When the sliding door 1 is moved in the closing direction manually, the retracting device 44 moves in the closing direction together with the sliding door 1. As illustrated in FIG. 21(*a*), when the first slider 14-1 reaches the retracting start position, the trigger catcher 18 rotates to catch the first trigger pin 8-1 and the first slider 14-1 becomes slidable relative to the base 42. As a pulling coil spring 15 is provided between the first slider 14-1 and the base 42, it causes such a pulling force as to slide the first slider 14-1. As the trigger catcher 18 catches the first trigger pin 8-1 fixed to the guide rail 2, the base 42 moves in the closing direction without movement of the trigger catcher 18. With movement of the base 42 in the closing direction, the damper base 22 engages with the base 42 by the damper lock 28 for the first slider, the damper base 22 also moves in the closing direction relative to the first slider 14-1. Therefore, a distance between the damper base 22 and the first slider 14-1 reduces and the linear damper 24 causes a damping force.

As illustrated in FIG. 21(*b*), when the base 42 reaches the damper switching position, the rod 24*b* is accommodated in the damper main body 24*a* completely and the damper base 22 abuts to the first slider 14-1. At the same time, the damper lock 28 for the first slider rotates and engagement between the damper lock 28 for the first slider and the base 42 is released. As a result, only the base 42 moves in the closing direction relative to the damper base 22 and the first slider 14-1. As the second slider 14-2 is locked to the base 42, the distance between the second slider 14-2 and the damper base 22 reduces and the linear damper 54 causes a damping force.

By providing the damper lock 28 for the first slider capable of engaging with the base 42 to the damper base 22, the linear damper 24 can operate first and then the linear damper 54 can operate. In the present exemplary embodiment, the damping force of the linear damper 24 and the damping force of the linear damper 54 are set to be approximately equal to each other. If the damper base 22 is not provided with the damper lock 28 for the first slider, it is uncertain which of the linear dampers 24 or 54 operates first. By providing the damper lock 28 for the first slider to the damper base 22, it is possible to eliminate such uncertainty.

The operation of the retracting device 44 when the sliding door 1 gets opened is the same as that when the sliding door 1 gets closed. In other words, when the second slider 14-2 reaches the retracting start position, the trigger catcher 18 rotates to catch the second trigger pin 8-2, the lock of the second slider 14-2 with the base 42 is released and the base 42 slides in the opening direction relative to the second slider 14-2. As the damper base 22 is engaging with the base 42 by the damper lock 58 for the second slider, the damper base 22 also moves in the opening direction relative to the second slider 14-2. Therefore, a distance between the damper base 22 and the second slider 14-2 reduces and the linear damper 54 causes a damping force.

Next, when the base 42 reaches the damper switching position, engagement between the damper lock 58 for the second slider and the base 42 is released. As a result, only the base 42 moves in the opening direction relative to the damper base 22 and the second slider 14-2. As the first slider 14-1 is locked to the base 42, the distance between first slider 14-1 and the damper base 22 reduces and the linear damper 24 causes a damping force. In other words, the linear damper 54 operates first and then the linear damper 24 operates.

Figure 22A:
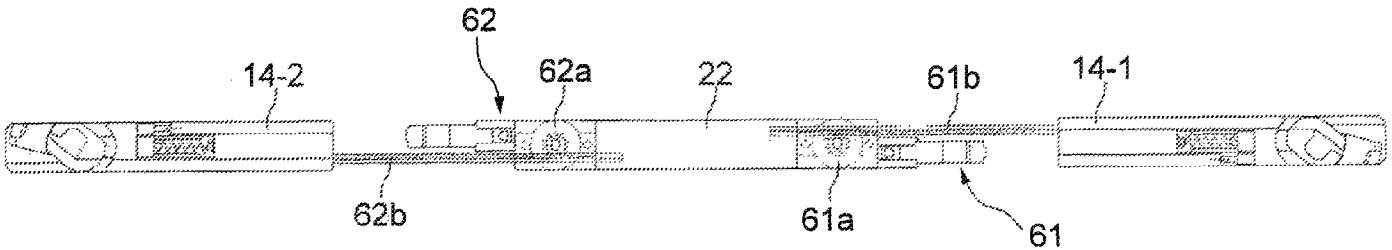
FIGS. 22(*a*) and 22(*b*) are views of another example of the retracting device according to the second exemplary embodiment of the invention (FIG. 22(*a*) illustrates an initial state and FIG. 22(*b*) illustrates a first slider that has moved toward a second slider).
Figure 22B:
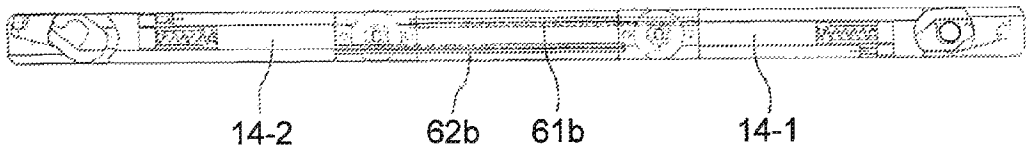

FIGS. 22(*a*) and 22(*b*) illustrate an example where rotary dampers 61 and 62 are used in place of the linear dampers 24 and 54 in the retracting device 44 according to the second exemplary embodiment of the invention. The damper main bodies 61*a* and 62*a* of the rotary dampers 61 and 62 are mounted to the damper base 22. Slide racks 61*b* and 62*b* engaging with pinions of the damper main bodies 61*a* and 62*a* are mounted to the first slider 14-1 and the second slider 14-2.

As illustrated in FIG. 22(*b*), when the lock between the first slider 14-1 and the base 42 is released and the first slider 14-1 gets the closest to the second slider 14-2, the slide rack 61*b* and the slide rack 62*b* overlap each other.

Figure 23A:
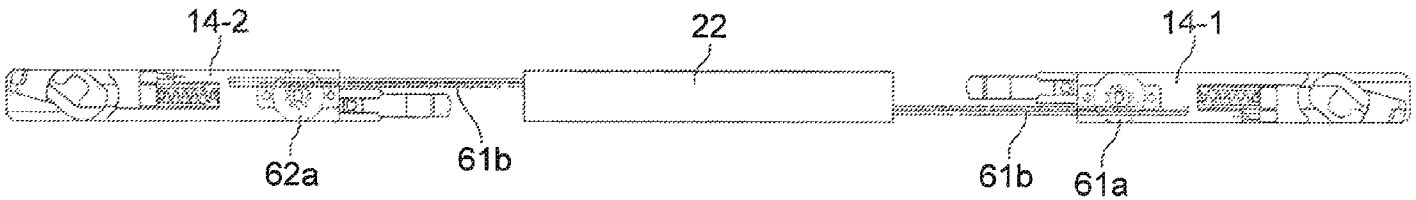
FIGS. 23(*a*) and 23(*b*) are views of another example of the retracting device according to the second exemplary embodiment of the invention (FIG. 23(*a*) illustrates an initial state and FIG. 23(*b*) illustrates a first slider that has moved toward a second slider).
Figure 23B:
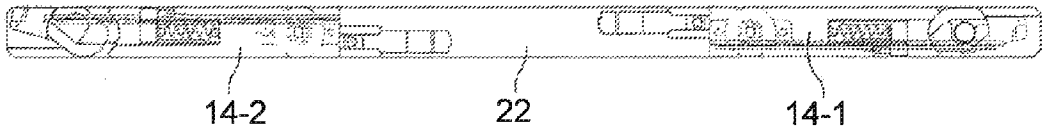

FIGS. 23(*a*) and 23(*b*) illustrate yet another example of the retracting device 44 according to the second exemplary embodiment of the invention. This example is different from the retracting device illustrated in FIGS. 22(*a*) and 22(*b*) in that the damper main bodies 61*a* and 62*a* of the rotary dampers are mounted to the first and second sliders 14-1 and 14-2 and that the slide racks 61*b* and 62*b* are mounted to the damper base 22.

The present invention is not limited to the above-described embodiments but may be modified in various forms without departing from the scope of the present invention. For example, the retracting device of the present invention may be used to assist closing and opening of the opening and closing body such as a folding door or a drawer, as well as a sliding door.

In the above-mentioned embodiments, the damper main body of the linear damper is mounted to the damper base and the rod of the linear damper is mounted to the first slider and/or second slider, but the damper main body of the linear damper may be mounted to the first slider and/or the second slider and the damper main body of the linear damper may be mounted to the damper base.

In the above-mentioned embodiments, the trigger catcher and the first slider or the second slider are separate members, but the trigger catcher and the first slider or the second slider may be combined into one piece.

In the above-mentioned embodiments, the pulling coil springs are provided as biasing members over between the base and the first slider and between the base and the second slider, but the pulling coil spring may be provided over between the first slider and the second slider.

As defined in the claim, the distance between the first slider and the damper base and the distance between the damper base and the second slider are reduced by relative movement of the base in the closing direction relative to the first slider due to the biasing force of the biasing member. The distance between the first slider and the damper base and the distance between the damper base and the second slider may be reduced in order, i.e., the distance between the first slider and the damper base may be reduced and then the distance between the damper base and the second slider may be reduced as described in the first and second exemplary embodiments. Alternatively, the distance between the first slider and the damper base and the distance between the damper base and the second slider may be reduced simultaneously, i.e., the distance between the damper base and the second slider may be reduced simultaneously with reduction of the distance between the first slider and the damper base. When the base moves in the opening direction relative to the second slider due to the biasing force of the biasing member, the distance between the second slider and the damper base and the distance between the damper base and the first slider may be reduced in order or simultaneously.

This application is based on the Japanese Patent application No. 2010-256338 filed on Nov. 16, 2010, entire content of which is expressly incorporated by reference herein.

REFERENCE SIGNS LIST

1 sliding door
2 guide rail
4 retracting device
8-1 first trigger pin
8-2 second trigger pin
12 base
12*d* lock hole (engaging hole)
14-1 first slider
14-2 second slider
15, 16 pulling coil spring (biasing member)
21 compression coil spring
22 damper base
42 base
24 linear damper (first damper)
25 rotary damper (second damper)
28 damper lock for first slider
44 retracting device
54 linear damper (second damper)
58 damper lock for second slider
61, 62 rotary damper (first and second dampers)

The invention claimed is:

1. A retracting device comprising:

a base extending in a longitudinal direction;

a first slider for assisting closing and provided in the base to be slidable in a longitudinal direction;

a second slider for assisting opening and provided in the base to be slidable in the longitudinal direction;

a damper base disposed between the first slider and the second slider to be slidable in the longitudinal direction relative to the base;

a first damper provided over between the first slider and the damper base to cause a damping force as a distance between the first slider and the damper base reduces; and a second damper provided over between the second slider and the damper base to cause a damping force as a distance between the second slider and the damper base reduces, wherein the distance between the first slider and the damper base and the distance between the damper base and the second slider reduce as the base moves in a closing direction relative to the first slider due to a biasing force of a first biasing member and the distance between the second slider and the damper base and the distance between the damper base and the first slider reduce as the base moves in an opening direction relative to the second slider due to a biasing force of a second biasing member.

2. A retracting device according to claim 1, wherein the damper base is provided with a damper lock for the first slider and for engaging with the base so as to prevent the damper base from sliding relative to the base in the longitudinal direction and for releasing engagement with the base so as to make the damper base slidable relative to the base in the longitudinal direction, when the base moves in the closing direction relative to the first slider due to the first biasing force of the biasing member, first the damper base engaging with the base by the damper lock for the first slider moves first in the closing direction relative to the first slider and, as a result, the first damper provided over between the first slider and the damper base causes the damping force, and then, the damper lock for the first slider and the base are disengaged, the base moves in the closing direction relative to the first slider and the damper base and, as a result, the second damper provided over between the second slider and the damper base causes the damping force.

3. A retracting device according to claim 2, wherein the damper base is provided with a damper lock for the second slider and for engaging with the base so as to prevent the damper base from sliding relative to the base in the longitudinal direction and for releasing engagement with the base so as to make the damper base slidable relative to the base in the longitudinal direction, when the base moves in the opening direction relative to the second slider due to the second biasing force of the biasing member, first the damper base engaging with the base by the damper lock for the second slider moves first in the opening direction relative to the second slider and, as a result, the second damper provided over between the second slider and the damper base causes the damping force, and then, the damper lock for the second slider and the base are disengaged, the base moves in the opening direction relative to the second slider and the damper base and, as a result, the first damper provided over between the first slider and the damper base causes the damping force.

4. A retracting device according to claim 3, wherein the first damper includes a linear damper having a rod extendable relative to a damper main body or a rotary damper having a rack engaging with a pinion rotatably provided to the damper main body, the second damper includes a linear damper having a rod extendable relative to a damper main body or a rotary damper having a rack engaging with a pinion rotatably provided to the damper main body, and the rod or the rack of the first damper and the rod or the rack of the second damper overlap each other when the distance between the first slider and the damper base reduces and the distance between the second slider and the damper base reduces.

5. A retracting device according to claim 2, wherein the first damper includes a linear damper having a rod extendable relative to a damper main body or a rotary damper having a rack engaging with a pinion rotatably provided to the damper main body, the second damper includes a linear damper having a rod extendable relative to a damper main body or a rotary damper having a rack engaging with a pinion rotatably provided to the damper main body, and the rod or the rack of the first damper and the rod or the rack of the second damper overlap each other when the distance between the first slider and the damper base reduces and the distance between the second slider and the damper base reduces.

6. A retracting device according to claim 1, wherein the damper base is provided with a damper lock for the second slider and for engaging with the base so as to prevent the damper base from sliding relative to the base in the longitudinal direction and for releasing engagement with the base so as to make the damper base slidable relative to the base in the longitudinal direction, when the base moves in the opening direction relative to the second slider due to the second biasing force of the biasing member, first the damper base engaging with the base by the damper lock for the second slider moves first in the opening direction relative to the second slider and, as a result, the second damper provided over between the second slider and the damper base causes the damping force, and then, the damper lock for the second slider and the base are disengaged, the base moves in the opening direction relative to the second slider and the damper base and, as a result, the first damper provided over between the first slider and the damper base causes the damping force.

7. A retracting device according to claim 6, wherein the first damper includes a linear damper having a rod extendable relative to a damper main body or a rotary damper having a rack engaging with a pinion rotatably provided to the damper main body, the second damper includes a linear damper having a rod extendable relative to a damper main body or a rotary damper having a rack engaging with a pinion rotatably provided to the damper main body, and the rod or the rack of the first damper and the rod or the rack of the second damper overlap each other when the distance between the first slider and the damper base reduces and the distance between the second slider and the damper base reduces.

8. A retracting device according to claim 1, wherein the first damper includes a linear damper having a rod extendable relative to a damper main body or a rotary damper having a rack engaging with a pinion rotatably provided to the damper main body, the second damper includes a linear damper having a rod extendable relative to a damper main body or a rotary damper having a rack engaging with a pinion rotatably provided to the damper main body, and the rod or the rack of the first damper and the rod or the rack of the second damper overlap each other when the distance between the first slider and the damper base reduces and the distance between the second slider and the damper base reduces.

* * * * *